US012168551B2

(12) United States Patent
van de Liefvoort et al.

(10) Patent No.: US 12,168,551 B2
(45) Date of Patent: Dec. 17, 2024

(54) METAL CONTAINER AND END CLOSURE WITH SEAL

(71) Applicant: Ball Corporation, Westminster, CO (US)

(72) Inventors: Matthias van de Liefvoort, Louisville, CO (US); Heidi Masters, Denver, CO (US)

(73) Assignee: Ball Corporation, Westminster, CO (US)

( * ) Notice: Subject to any disclaimer, the term of this patent is extended or adjusted under 35 U.S.C. 154(b) by 0 days.

(21) Appl. No.: 17/683,571

(22) Filed: Mar. 1, 2022

(65) Prior Publication Data

US 2022/0274743 A1 Sep. 1, 2022

Related U.S. Application Data

(60) Provisional application No. 63/155,076, filed on Mar. 1, 2021.

(51) Int. Cl.

| | |
|---|---|
| ***B65D 43/02*** | (2006.01) |
| ***B65D 17/00*** | (2006.01) |
| ***B65D 17/28*** | (2006.01) |
| ***B65D 17/50*** | (2006.01) |

(52) U.S. Cl.

CPC ..... *B65D 43/0212* (2013.01); *B65D 17/02* (2013.01); *B65D 17/4011* (2018.01); *B65D 17/50* (2013.01)

(58) Field of Classification Search

CPC .... B65D 7/36; B65D 43/0212; B65D 1/0253; B65D 1/0246

USPC ..... 220/799, 835, 309.2, 784

See application file for complete search history.

(56) References Cited

U.S. PATENT DOCUMENTS

| | | | |
|---|---|---|---|
| 1,092,902 | A | 4/1914 | Doggett |
| 1,145,915 | A | 7/1915 | Marcuse |
| 1,254,251 | A | 1/1918 | Magnus |
| 1,482,761 | A | 2/1924 | Arlington |
| 1,527,746 | A | 2/1925 | Miller et al. |

(Continued)

FOREIGN PATENT DOCUMENTS

| | | |
|---|---|---|
| CN | 106314987 | 1/2017 |
| DE | 8318647 | 8/1984 |

(Continued)

OTHER PUBLICATIONS

US 9,505,538 B2, 11/2016, Loftin et al. (withdrawn)

(Continued)

*Primary Examiner* — Jeffrey R Allen

(74) *Attorney, Agent, or Firm* — Sheridan Ross P.C.

(57) ABSTRACT

Embodiments of the present invention include food and beverage packaging utilizing heat seal technology, and specifically include food and beverage containers with end closures having seals or liners and snap-fit closure mechanisms. In some embodiments, the food and beverage containers and the end closures are metal. In further embodiments, the food and beverage containers include a domed portion on the bottom closed end. The end closures can snap onto the food and beverage containers such that the packaging is reclosable. Moreover, the sealed packaging with reclosable features can retain a variety of internal pressures including pressures higher than possible with the heat seal alone.

17 Claims, 14 Drawing Sheets

(56) References Cited

U.S. PATENT DOCUMENTS 1,540,726 A 6/1925 Arlington
1,541,146 A 6/1925 Huntley
1,574,710 A 2/1926 Spreen
1,602,925 A 10/1926 Arlington
1,625,335 A 4/1927 Schneider
1,627,047 A 5/1927 Arlington
1,818,924 A 8/1931 Aronseag
1,836,220 A 12/1931 Bloom
1,885,757 A 11/1932 Orlopp
1,889,328 A 11/1932 Fessenden
2,034,739 A 3/1936 Bodor
2,046,609 A 7/1936 Grover
2,167,619 A 8/1939 Raymond
2,193,521 A 3/1940 Roach
D136,321 S 9/1943 Voglesong
2,453,274 A 11/1948 Serowy
2,453,393 A 11/1948 Wilson
2,529,114 A 11/1950 Andre
2,726,012 A 12/1955 Jensen
2,761,301 A 9/1956 Andre
3,048,297 A 8/1962 Elliott et al.
3,150,811 A 9/1964 Amberg
3,164,289 A 1/1965 Cocchiarella
3,195,764 A 7/1965 Louis et al.
3,253,727 A 5/1966 Hart
3,266,662 A 8/1966 Palmer
3,360,161 A 12/1967 Smith
D209,786 S 1/1968 Schwartz et al.
3,380,624 A 4/1968 Gilbert et al.
D211,158 S 5/1968 Yates
3,722,784 A 3/1973 Harper
D229,824 S 1/1974 Erickson
3,809,284 A * 5/1974 Churan ..... B65D 43/0212 220/792
3,856,176 A 12/1974 Carter
3,931,925 A 1/1976 Ruff
D239,437 S 4/1976 Boduch
3,987,941 A 10/1976 Blessing
4,011,347 A 3/1977 Griffith
4,016,968 A 4/1977 Stelter
D244,742 S 6/1977 Daenen
D245,018 S 7/1977 Harris
4,094,435 A 6/1978 Kennedy
4,109,815 A * 8/1978 Collins, III ..... B29C 66/836 215/277
4,127,187 A 11/1978 Smith
RE29,898 E 2/1979 Wheeler
4,197,956 A 4/1980 Murayama
4,207,725 A 6/1980 Smith
D256,887 S 9/1980 Swade et al.
D264,690 S 6/1982 Bagwell
D269,160 S 5/1983 Carney, Jr.
4,413,747 A 11/1983 Tenold et al.
4,416,387 A 11/1983 D'Antonio
D276,595 S 12/1984 Miller
4,503,990 A * 3/1985 Roth ..... B65D 79/0087 220/276
4,556,152 A 12/1985 Bogren
4,625,883 A 12/1986 Burke et al.
4,625,886 A 12/1986 Eisenman
4,643,329 A 2/1987 Mobberley et al.
D289,613 S 5/1987 Daenen et al.
4,682,705 A 7/1987 Hurwitz
D291,536 S 8/1987 Crawford et al.
4,723,674 A 2/1988 Nunes
D299,009 S 12/1988 Schneider
D299,010 S 12/1988 Wall
4,842,157 A 6/1989 Stone-Parker et al.
4,874,108 A 10/1989 Valasek
4,938,377 A 7/1990 Jarvis
4,940,158 A 7/1990 Farrell et al.
D310,028 S 8/1990 Brandt
5,004,118 A 4/1991 England et al.
5,009,310 A 4/1991 Finney
D319,982 S 9/1991 Matthews
D322,940 S 1/1992 Rivera
5,105,973 A 4/1992 Jentzsch et al.
5,133,474 A 7/1992 Smith et al.
D334,710 S 4/1993 Picozza
5,213,230 A 5/1993 Kral
D336,817 S 6/1993 Wilcox, Jr.
5,222,385 A 6/1993 Halasz et al.
D339,027 S 9/1993 Mack et al.
5,242,077 A 9/1993 Smith et al.
D341,320 S 11/1993 Morin
D344,209 S 2/1994 Cousins et al.
5,339,981 A 8/1994 Kral
5,355,709 A 10/1994 Bauder et al.
5,361,933 A 11/1994 Oster
D353,768 S 12/1994 Hayes
D356,034 S 3/1995 Sugrue
5,402,908 A 4/1995 Warden et al.
D361,512 S 8/1995 Dalmaz
5,524,468 A 6/1996 Jentzsch et al.
5,540,352 A 7/1996 Halasz et al.
5,579,943 A 12/1996 Johnson
5,588,552 A 12/1996 Johnson
5,620,134 A 4/1997 Gulliver
5,692,714 A 12/1997 Morrison
5,697,242 A 12/1997 Halasz et al.
5,697,548 A 12/1997 Halsell
5,704,241 A 1/1998 Babbit et al.
5,706,686 A 1/1998 Babbit et al.
5,706,983 A 1/1998 Dobbs et al.
5,713,469 A 2/1998 Buscema
5,738,250 A 4/1998 Gillingham et al.
5,785,198 A 7/1998 Credle, Jr.
5,799,797 A 9/1998 Braun
5,799,864 A 9/1998 Mertz
5,810,211 A 9/1998 Shanklin et al.
5,816,447 A 10/1998 Shanklin et al.
5,823,395 A 10/1998 Foster et al.
5,839,617 A 11/1998 Cater et al.
5,845,820 A 12/1998 Foster
5,853,120 A 12/1998 McLeod et al.
5,860,574 A 1/1999 Shanklin et al.
D405,692 S 2/1999 Johnson
5,873,496 A 2/1999 Montaner et al.
D406,237 S 3/1999 Bettiga
5,887,761 A 3/1999 Foster et al.
D407,944 S 4/1999 Filbrun
5,890,632 A 4/1999 Chelupsky et al.
5,890,633 A 4/1999 Skillin et al.
5,890,649 A 4/1999 Baxter
5,899,363 A 5/1999 Bliss, III et al.
5,915,571 A 6/1999 Czalkiewicz et al.
5,918,782 A 7/1999 Shanklin et al.
5,934,127 A 8/1999 Ihly
5,934,474 A 8/1999 Renninger et al.
5,938,081 A 8/1999 Foster et al.
5,947,368 A 9/1999 Thresher et al.
5,971,202 A 10/1999 Filbrun
5,975,376 A 11/1999 Chelupsky et al.
5,979,712 A 11/1999 Montaner et al.
5,979,746 A 11/1999 McLeod et al.
5,984,120 A 11/1999 Johnske et al.
5,984,151 A 11/1999 Lohrman et al.
D418,060 S 12/1999 Villiers
6,003,738 A 12/1999 Foster et al.
6,006,949 A 12/1999 Foster et al.
6,010,028 A 1/2000 Jordan et al.
6,027,017 A 2/2000 Kuhn et al.
6,032,834 A 3/2000 Keung et al.
6,045,008 A 4/2000 Gonzalez et al.
6,047,829 A 4/2000 Johnsone et al.
6,050,459 A 4/2000 Johnson et al.
6,053,371 A 4/2000 Durliat et al.
6,065,634 A 5/2000 Brifcani et al.
6,065,647 A 5/2000 Bliss, III et al.
6,089,414 A 7/2000 Shanklin et al.
6,095,377 A 8/2000 Sweeton et al.
6,113,719 A 9/2000 Parks et al.
6,116,472 A 9/2000 Wanbaugh et al.
6,123,236 A 9/2000 Bloom

(56) References Cited

U.S. PATENT DOCUMENTS

| | | | |
|---|---|---|---|
| 6,126,090 | A | 10/2000 | Wadsworth et al. |
| 6,129,266 | A | 10/2000 | Oliff et al. |
| 6,131,803 | A | 10/2000 | Oliff et al. |
| 6,139,938 | A | 10/2000 | Lingle et al. |
| 6,149,993 | A | 11/2000 | Parks et al. |
| 6,155,462 | A | 12/2000 | Brecheisen et al. |
| 6,155,479 | A | 12/2000 | Wellner et al. |
| 6,158,625 | A | 12/2000 | Siegel et al. |
| D436,034 | S | 1/2001 | Wolff |
| 6,170,674 | B1 | 1/2001 | Caterinacci |
| 6,173,863 | B1 | 1/2001 | Brozell et al. |
| 6,173,868 | B1 | 1/2001 | DeJonge |
| 6,186,364 | B1 | 2/2001 | Dobbs |
| 6,186,365 | B1 | 2/2001 | DeJonge |
| 6,186,366 | B1 | 2/2001 | Good et al. |
| 6,189,687 | B1 | 2/2001 | Bakx |
| 6,193,827 | B1 | 2/2001 | Parks et al. |
| D438,798 | S | 3/2001 | Wadsworth |
| D439,366 | S | 3/2001 | Tortosa |
| 6,206,280 | B1 | 3/2001 | Thresher et al. |
| 6,214,766 | B1 | 4/2001 | Kurrle |
| 6,216,912 | B1 | 4/2001 | Keung et al. |
| D441,290 | S | 5/2001 | West |
| 6,223,951 | B1 | 5/2001 | Siegel et al. |
| 6,227,411 | B1 | 5/2001 | Good |
| 6,230,893 | B1 | 5/2001 | Karow |
| 6,234,361 | B1 | 5/2001 | Bloom |
| 6,234,412 | B1 | 5/2001 | Von Schuckmann |
| 6,244,473 | B1 | 6/2001 | Keung et al. |
| 6,247,585 | B1 | 6/2001 | Holley |
| 6,250,510 | B1 | 6/2001 | Durliat et al. |
| D445,687 | S | 7/2001 | Gilbertson |
| D445,983 | S | 7/2001 | Laughton |
| 6,253,993 | B1 | 7/2001 | Lloyd et al. |
| 6,257,451 | B1 | 7/2001 | Siegel et al. |
| 6,257,455 | B1 | 7/2001 | Trepina et al. |
| 6,260,755 | B1 | 7/2001 | Bates et al. |
| 6,263,781 | B1 | 7/2001 | Calagui |
| 6,264,073 | B1 | 7/2001 | Good et al. |
| 6,269,976 | B1 | 8/2001 | DeJonge |
| 6,273,330 | B1 | 8/2001 | Oliff et al. |
| 6,286,728 | B1 | 9/2001 | Driskell et al. |
| 6,296,154 | B1 | 10/2001 | Shanklin et al. |
| 6,296,175 | B1 | 10/2001 | Dixon |
| 6,315,123 | B1 | 11/2001 | Ikeda |
| 6,315,162 | B1 | 11/2001 | Brozell et al. |
| 6,315,167 | B2 | 11/2001 | Brecheisen et al. |
| D451,581 | S | 12/2001 | Shanklin et al. |
| 6,332,562 | B1 | 12/2001 | Sweeton |
| 6,334,549 | B1 | 1/2002 | Fernandez et al. |
| 6,343,719 | B2 | 2/2002 | Ferrell et al. |
| 6,346,332 | B1 | 2/2002 | Bryden et al. |
| 6,358,191 | B1 | 3/2002 | Greever |
| 6,360,922 | B1 | 3/2002 | Englhard et al. |
| 6,364,171 | B1 | 4/2002 | Chalupsky et al. |
| 6,364,173 | B1 | 4/2002 | Laffey et al. |
| 6,364,174 | B1 | 4/2002 | Lohrman et al. |
| 6,364,175 | B2 | 4/2002 | Bloom |
| 6,367,665 | B1 | 4/2002 | Barriac et al. |
| 6,382,527 | B1 | 5/2002 | Dukes et al. |
| 6,394,742 | B1 | 5/2002 | Buscema |
| 6,398,064 | B1 | 6/2002 | Cornwall |
| 6,409,052 | B1 | 6/2002 | Barriac et al. |
| 6,412,636 | B1 | 7/2002 | Jones et al. |
| 6,419,110 | B1 | 7/2002 | Stodd |
| 6,419,128 | B1 | 7/2002 | Barriac et al. |
| 6,425,501 | B1 | 7/2002 | Keung et al. |
| 6,439,481 | B2 | 8/2002 | Von Schuckmann |
| 6,443,329 | B1 | 9/2002 | Rochefort et al. |
| 6,443,331 | B1 | 9/2002 | DeJonge |
| 6,467,657 | B2 | 10/2002 | Shanklin et al. |
| 6,478,219 | B1 | 11/2002 | Holley |
| D467,500 | S | 12/2002 | Cudmore et al. |
| 6,481,571 | B1 | 12/2002 | Kelders et al. |
| 6,508,395 | B2 | 1/2003 | McLeod |
| 6,524,048 | B1 | 2/2003 | Tsukada et al. |
| D471,105 | S | 3/2003 | Gonzalez |
| 6,530,516 | B1 | 3/2003 | Ritter et al. |
| 6,536,686 | B2 | 3/2003 | Dukes et al. |
| 6,547,162 | B1 | 4/2003 | De Regt et al. |
| 6,554,319 | B2 | 4/2003 | Barriac et al. |
| 6,557,783 | B1 | 5/2003 | Foster et al. |
| D475,294 | S | 6/2003 | Foster et al. |
| 6,571,941 | B2 | 6/2003 | Holley |
| 6,578,776 | B1 | 6/2003 | Shanklin et al. |
| D476,566 | S | 7/2003 | Smith et al. |
| 6,591,832 | B1 | 7/2003 | DeJonge |
| 6,596,105 | B2 | 7/2003 | Kendall |
| 6,598,784 | B2 | 7/2003 | Lebras et al. |
| 6,616,393 | B1 | 9/2003 | Jentzsch |
| 6,619,495 | B1 | 9/2003 | Pares et al. |
| 6,619,514 | B1 | 9/2003 | Costa et al. |
| 6,637,626 | B1 | 10/2003 | Bloom |
| 6,641,003 | B1 | 11/2003 | Foster et al. |
| 6,644,516 | B1 | 11/2003 | Foster et al. |
| D484,572 | S | 12/2003 | Shanklin et al. |
| 6,659,311 | B2 | 12/2003 | Prueter |
| 6,659,369 | B1 | 12/2003 | Foster et al. |
| 6,662,946 | B2 | 12/2003 | Bakx |
| 6,669,058 | B1 | 12/2003 | Sweeton |
| 6,669,081 | B2 | 12/2003 | Hearne et al. |
| 6,669,083 | B2 | 12/2003 | Bates |
| 6,669,814 | B2 | 12/2003 | Hansen et al. |
| 6,672,520 | B2 | 1/2004 | Shanklin et al. |
| 6,681,961 | B2 | 1/2004 | Montaner et al. |
| 6,695,176 | B1 | 3/2004 | Nazari |
| 6,702,157 | B1 | 3/2004 | Dobbs et al. |
| D488,378 | S | 4/2004 | Costa |
| D488,380 | S | 4/2004 | Dobbs et al. |
| D488,535 | S | 4/2004 | Foster et al. |
| 6,715,623 | B2 | 4/2004 | Broerman |
| 6,715,698 | B2 | 4/2004 | Foster et al. |
| D490,300 | S | 5/2004 | Costa |
| 6,729,500 | B1 | 5/2004 | Dobbs et al. |
| 6,732,857 | B2 | 5/2004 | Bakx |
| 6,749,071 | B2 | 6/2004 | Caterinacci |
| 6,752,272 | B2 | 6/2004 | Jones et al. |
| 6,752,280 | B2 | 6/2004 | Dye |
| 6,752,296 | B1 | 6/2004 | Sweeton et al. |
| 6,752,350 | B2 | 6/2004 | Robards |
| D492,598 | S | 7/2004 | Foster et al. |
| 6,764,435 | B1 | 7/2004 | Hennessy |
| D493,718 | S | 8/2004 | Durdon |
| D495,134 | S | 8/2004 | Geert-Jensen |
| 6,772,893 | B2 | 8/2004 | Pares et al. |
| 6,772,920 | B2 | 8/2004 | Shanklin et al. |
| 6,772,966 | B2 | 8/2004 | Foster et al. |
| 6,779,693 | B2 | 8/2004 | Sweeton et al. |
| D496,270 | S | 9/2004 | Baxter |
| 6,793,070 | B2 | 9/2004 | Dye |
| 6,793,156 | B2 | 9/2004 | Dobbs et al. |
| D499,024 | S | 11/2004 | Sweeton |
| D499,167 | S | 11/2004 | Sweeton |
| 6,814,259 | B1 | 11/2004 | Foster et al. |
| 6,820,769 | B2 | 11/2004 | Foster et al. |
| 6,822,554 | B2 | 11/2004 | Vrijens et al. |
| 6,833,055 | B2 | 12/2004 | Hansen et al. |
| 6,837,089 | B2 | 1/2005 | Jentzsch |
| 6,840,408 | B1 | 1/2005 | Foster et al. |
| 6,845,922 | B2 | 1/2005 | Stark |
| 6,863,175 | B2 | 3/2005 | Gelardi |
| D503,614 | S | 4/2005 | Sax et al. |
| D503,887 | S | 4/2005 | Pietrowski et al. |
| D504,053 | S | 4/2005 | Bertulis |
| D504,066 | S | 4/2005 | King |
| D505,326 | S | 5/2005 | Costa |
| 6,886,718 | B2 | 5/2005 | Foster et al. |
| 6,886,737 | B2 | 5/2005 | Dye et al. |
| D506,134 | S | 6/2005 | Foster et al. |
| 6,902,104 | B2 | 6/2005 | Holley et al. |
| 6,905,066 | B2 | 6/2005 | Holley et al. |
| 6,913,149 | B2 | 7/2005 | Gelardi et al. |
| 6,913,209 | B2 | 7/2005 | Shanklin et al. |
| 6,923,346 | B2 | 8/2005 | Foster et al. |

(56) References Cited

U.S. PATENT DOCUMENTS

| | | | |
|---|---|---|---|
| 6,932,265 | B2 | 8/2005 | Sax et al. |
| 6,935,504 | B2 | 8/2005 | Ritter et al. |
| 6,935,509 | B2 | 8/2005 | Egresitz et al. |
| 6,942,113 | B1 | 9/2005 | Johnske et al. |
| 6,942,125 | B2 | 9/2005 | Marelli et al. |
| D510,521 | S | 10/2005 | Lebras |
| 6,951,282 | B2 | 10/2005 | Jones |
| 6,953,133 | B2 | 10/2005 | Englhard et al. |
| 6,953,297 | B2 | 10/2005 | Dobbs et al. |
| 6,959,577 | B2 | 11/2005 | Jentzsch |
| 6,966,447 | B2 | 11/2005 | Hiltke et al. |
| 6,974,033 | B2 | 12/2005 | McLeod et al. |
| 6,976,588 | B2 | 12/2005 | Wischusen et al. |
| 6,978,946 | B2 | 12/2005 | Sweeton |
| 6,983,874 | B2 | 1/2006 | Bakx |
| D516,439 | S | 3/2006 | Cargile et al. |
| 7,007,825 | B2 | 3/2006 | Crosland et al. |
| 7,017,833 | B2 | 3/2006 | Foster |
| D519,602 | S | 4/2006 | Dodd |
| 7,032,777 | B2 | 4/2006 | Good et al. |
| 7,032,783 | B1 | 4/2006 | Kamp et al. |
| 7,036,689 | B1 | 5/2006 | Laffey |
| D523,748 | S | 6/2006 | Witkowski et al. |
| 7,063,208 | B2 | 6/2006 | Lebras |
| 7,063,277 | B2 | 6/2006 | Englhard et al. |
| 7,066,379 | B2 | 6/2006 | McLeod et al. |
| D525,124 | S | 7/2006 | Sweeton |
| D525,525 | S | 7/2006 | Sweeton |
| 7,073,665 | B2 | 7/2006 | Auclair et al. |
| 7,086,545 | B2 | 8/2006 | Mannion et al. |
| 7,090,403 | B2 | 8/2006 | Orlowski et al. |
| 7,094,194 | B2 | 8/2006 | Barner |
| D528,926 | S | 9/2006 | Blin |
| 7,104,416 | B2 | 9/2006 | Gasco et al. |
| D530,201 | S | 10/2006 | Sweeton |
| 7,118,049 | B2 | 10/2006 | Dodd |
| 7,121,453 | B2 | 10/2006 | Nass |
| 7,124,914 | B2 | 10/2006 | Foster et al. |
| 7,128,227 | B2 | 10/2006 | Skillin et al. |
| 7,134,547 | B2 | 11/2006 | Auclair et al. |
| D533,078 | S | 12/2006 | Lebras |
| D533,918 | S | 12/2006 | Dodd |
| 7,144,635 | B2 | 12/2006 | Hawes et al. |
| 7,147,133 | B2 | 12/2006 | Brouwer et al. |
| D535,560 | S | 1/2007 | Sweeton |
| D535,876 | S | 1/2007 | Le Bras |
| 7,159,736 | B1 | 1/2007 | Torelli |
| 7,170,823 | B2 | 1/2007 | Fabricius et al. |
| 7,175,111 | B2 | 2/2007 | Wanbaugh et al. |
| 7,178,694 | B2 | 2/2007 | Costa et al. |
| 7,188,786 | B2 | 3/2007 | Dodd |
| 7,195,138 | B2 | 3/2007 | Foster |
| 7,198,180 | B2 | 3/2007 | Foster et al. |
| D539,646 | S | 4/2007 | Hollis et al. |
| D540,166 | S | 4/2007 | Hollis et al. |
| D541,150 | S | 4/2007 | Holley, Jr. |
| D541,653 | S | 4/2007 | Holley |
| 7,198,149 | B2 | 4/2007 | Gelardi |
| 7,198,178 | B2 | 4/2007 | Shanklin et al. |
| 7,207,474 | B2 | 4/2007 | Holley |
| D541,654 | S | 5/2007 | Pietrowski et al. |
| D543,106 | S | 5/2007 | Foster et al. |
| 7,219,848 | B2 | 5/2007 | Sweeton |
| 7,222,802 | B2 | 5/2007 | Sweeton |
| D544,353 | S | 6/2007 | Dodd |
| 7,229,030 | B2 | 6/2007 | Shanklin et al. |
| D547,182 | S | 7/2007 | Foster et al. |
| D548,078 | S | 8/2007 | Foster |
| 7,255,244 | B2 | 8/2007 | Miller |
| 7,255,293 | B2 | 8/2007 | Dodd |
| 7,255,294 | B2 | 8/2007 | Sweeton et al. |
| D551,973 | S | 10/2007 | Hildebrand |
| D552,946 | S | 10/2007 | Shanklin et al. |
| D555,471 | S | 11/2007 | Lebras et al. |
| 7,303,150 | B2 | 12/2007 | Hildebrand |
| 7,306,122 | B2 | 12/2007 | Stark et al. |
| 7,311,227 | B2 | 12/2007 | Foster |
| D559,104 | S | 1/2008 | Le Bras |
| 7,314,150 | B2 | 1/2008 | Skillin |
| 7,314,159 | B2 | 1/2008 | Rochefort et al. |
| 7,322,493 | B2 | 1/2008 | Skillin |
| D562,683 | S | 2/2008 | Sweeton et al. |
| D562,684 | S | 2/2008 | Brashear |
| 7,325,705 | B2 | 2/2008 | Sweeton |
| 7,325,706 | B2 | 2/2008 | Sweeton et al. |
| 7,325,752 | B2 | 2/2008 | Shanklin et al. |
| 7,328,798 | B2 | 2/2008 | Holley |
| 7,328,857 | B2 | 2/2008 | Englhard et al. |
| 7,331,505 | B2 | 2/2008 | Holley |
| 7,341,168 | B2 | 3/2008 | Shanklin et al. |
| 7,344,053 | B2 | 3/2008 | Sweeton |
| D567,082 | S | 4/2008 | Hildebrand |
| D567,083 | S | 4/2008 | Welp et al. |
| 7,350,670 | B2 | 4/2008 | Steeves et al. |
| 7,350,675 | B2 | 4/2008 | Sweeton |
| 7,350,722 | B2 | 4/2008 | Shanklin et al. |
| 7,357,254 | B2 | 4/2008 | Auclair et al. |
| 7,360,672 | B2 | 4/2008 | Sweeton |
| D569,726 | S | 5/2008 | Hildebrand |
| 7,374,076 | B2 | 5/2008 | Holley |
| 7,374,528 | B2 | 5/2008 | Yoder et al. |
| 7,377,378 | B2 | 5/2008 | Cash, III |
| D570,095 | S | 6/2008 | Ullersted et al. |
| D570,214 | S | 6/2008 | Foster et al. |
| D571,202 | S | 6/2008 | Vogt |
| D571,204 | S | 6/2008 | Sweeton et al. |
| D571,205 | S | 6/2008 | Sweeton et al. |
| D571,206 | S | 6/2008 | Sweeton et al. |
| D571,831 | S | 6/2008 | Ota et al. |
| 7,381,176 | B2 | 6/2008 | Graham et al. |
| 7,389,909 | B2 | 6/2008 | Crosland et al. |
| 7,392,894 | B2 | 7/2008 | Jacob et al. |
| 7,396,017 | B2 | 7/2008 | Orlowski et al. |
| 7,401,702 | B2 | 7/2008 | Hession |
| D574,707 | S | 8/2008 | Pietrowski et al. |
| D575,152 | S | 8/2008 | Costa |
| 7,407,117 | B2 | 8/2008 | Dodd |
| 7,427,004 | B2 | 9/2008 | Shanklin et al. |
| D578,887 | S | 10/2008 | Sweeton et al. |
| D579,329 | S | 10/2008 | Sweeton et al. |
| D579,330 | S | 10/2008 | Sweeton et al. |
| 7,434,721 | B2 | 10/2008 | Feltz |
| D579,773 | S | 11/2008 | Ribera et al. |
| D580,759 | S | 11/2008 | Sweeton et al. |
| D580,760 | S | 11/2008 | Costa |
| D580,761 | S | 11/2008 | Sweeton |
| 7,451,878 | B2 | 11/2008 | Rochefort et al. |
| 7,452,317 | B2 | 11/2008 | Graham et al. |
| 7,455,198 | B2 | 11/2008 | Foster et al. |
| 7,455,215 | B2 | 11/2008 | McLeod et al. |
| D581,783 | S | 12/2008 | Dixon |
| D583,668 | S | 12/2008 | Sweeton |
| 7,467,752 | B2 | 12/2008 | Sweeton |
| 7,470,225 | B2 | 12/2008 | Herrin |
| 7,470,226 | B1 | 12/2008 | Herrin |
| D584,616 | S | 1/2009 | Ribera et al. |
| 7,472,806 | B2 | 1/2009 | Good |
| 7,475,783 | B2 | 1/2009 | Geert-Jensen |
| 7,478,739 | B2 | 1/2009 | Foster |
| 7,478,743 | B2 | 1/2009 | Holley |
| 7,484,655 | B2 | 2/2009 | McLeod |
| 7,490,741 | B2 | 2/2009 | Rochefort et al. |
| D587,575 | S | 3/2009 | Hildebrand |
| D587,577 | S | 3/2009 | Ribera et al. |
| D587,999 | S | 3/2009 | Schulthess |
| D588,003 | S | 3/2009 | Sweeton et al. |
| D588,004 | S | 3/2009 | Hildebrand |
| D588,005 | S | 3/2009 | Boes et al. |
| D588,006 | S | 3/2009 | Boes et al. |
| D588,454 | S | 3/2009 | DeJong et al. |
| D588,455 | S | 3/2009 | Sweeton et al. |
| D588,456 | S | 3/2009 | DeJong et al. |
| 7,497,358 | B2 | 3/2009 | Clynes et al. |
| 7,497,360 | B2 | 3/2009 | Sweeton |

(56) References Cited

U.S. PATENT DOCUMENTS

| | | | |
|---|---|---|---|
| 7,510,101 | B2 | 3/2009 | Foster et al. |
| D589,795 | S | 4/2009 | Sweeton et al. |
| D590,256 | S | 4/2009 | Welp et al. |
| D590,712 | S | 4/2009 | Sweeton |
| 7,513,442 | B2 | 4/2009 | Dodd |
| 7,521,827 | B2 | 4/2009 | Orlowski et al. |
| 7,552,824 | B2 | 6/2009 | Le |
| D597,838 | S | 8/2009 | Stuart |
| D598,750 | S | 8/2009 | Boes et al. |
| 7,571,835 | B2 | 8/2009 | Hill et al. |
| 7,571,836 | B2 | 8/2009 | Foster et al. |
| D600,119 | S | 9/2009 | Sweeton |
| 7,588,149 | B2 | 9/2009 | Gelardi et al. |
| 7,591,372 | B2 | 9/2009 | Gelardi et al. |
| 7,597,213 | B2 | 10/2009 | McDonald |
| 7,607,539 | B2 | 10/2009 | Freeze |
| D603,312 | S | 11/2009 | Couture |
| 7,617,926 | B2 | 11/2009 | Jacob et al. |
| 7,617,954 | B2 | 11/2009 | Skillin |
| 7,631,789 | B2 | 12/2009 | Dood |
| 7,631,819 | B2 | 12/2009 | Shanklin et al. |
| 7,631,878 | B1 | 12/2009 | Orlowski et al. |
| 7,637,396 | B2 | 12/2009 | Foster et al. |
| 7,637,402 | B2 | 12/2009 | Romanov et al. |
| 7,641,072 | B1 | 1/2010 | Vlastakis et al. |
| 7,641,607 | B2 | 1/2010 | Martin |
| 7,647,752 | B2 | 1/2010 | Magnell |
| 7,649,870 | B2 | 1/2010 | Kado |
| 7,651,024 | B2 | 1/2010 | Barner |
| 7,651,032 | B2 | 1/2010 | Shanton |
| 7,654,419 | B2 | 2/2010 | Dobbs et al. |
| 7,658,287 | B2 | 2/2010 | Hession |
| 7,665,654 | B2 | 2/2010 | McLeod |
| 7,672,872 | B2 | 3/2010 | Shanton |
| 7,673,854 | B2 | 3/2010 | Brouwer et al. |
| 7,677,416 | B2 | 3/2010 | Foster et al. |
| 7,682,300 | B2 | 3/2010 | Graham et al. |
| 7,686,237 | B2 | 3/2010 | Wanbaugh et al. |
| D615,860 | S | 5/2010 | Cero, Jr. |
| 7,708,154 | B2 | 5/2010 | Lang et al. |
| 7,712,636 | B2 | 5/2010 | Foster et al. |
| 7,717,838 | B2 | 5/2010 | Strong et al. |
| 7,718,132 | B2 | 5/2010 | Thomson et al. |
| 7,722,819 | B2 | 5/2010 | Thomson et al. |
| 7,726,518 | B2 | 6/2010 | Brouwer |
| 7,726,661 | B2 | 6/2010 | Orlowski et al. |
| 7,735,299 | B2 | 6/2010 | Cash |
| 7,735,688 | B2 | 6/2010 | Foster et al. |
| 7,735,692 | B2 | 6/2010 | Nelson |
| 7,735,693 | B2 | 6/2010 | Pares et al. |
| 7,735,699 | B2 | 6/2010 | Brannon et al. |
| 7,735,753 | B2 | 6/2010 | Marelli et al. |
| 7,735,754 | B2 | 6/2010 | Marelli et al. |
| 7,739,856 | B2 | 6/2010 | Cash |
| 7,749,583 | B2 | 7/2010 | Fugitt et al. |
| 7,757,879 | B2 | 7/2010 | Schuetz et al. |
| 7,757,901 | B2 | 7/2010 | Welp |
| 7,762,438 | B2 | 7/2010 | Skillin |
| D621,260 | S | 8/2010 | Brannon et al. |
| D622,143 | S | 8/2010 | Hildebrand |
| 7,775,405 | B2 | 8/2010 | Sweeton et al. |
| 7,775,406 | B2 | 8/2010 | Foster et al. |
| 7,780,098 | B2 | 8/2010 | Foster et al. |
| D624,413 | S | 9/2010 | Selina et al. |
| 7,789,275 | B2 | 9/2010 | Englhard et al. |
| 7,793,803 | B2 | 9/2010 | Neerincx |
| 7,798,328 | B2 | 9/2010 | Hession |
| 7,802,677 | B2 | 9/2010 | Williams |
| 7,803,099 | B2 | 9/2010 | Biraud et al. |
| 7,810,640 | B2 | 10/2010 | Weston |
| D628,066 | S | 11/2010 | Costa |
| 7,828,231 | B2 | 11/2010 | Harms |
| D628,884 | S | 12/2010 | Smith |
| D629,685 | S | 12/2010 | Brannon et al. |
| 7,845,496 | B2 | 12/2010 | Hession |
| 7,857,743 | B2 | 12/2010 | Barner |
| 7,861,917 | B2 | 1/2011 | Rochefort et al. |
| 7,870,977 | B2 | 1/2011 | Pietrowski et al. |
| 7,870,993 | B2 | 1/2011 | Walling |
| 7,882,966 | B2 | 2/2011 | Field et al. |
| 7,886,941 | B2 | 2/2011 | Pietrowski et al. |
| 7,886,958 | B2 | 2/2011 | Smith et al. |
| 7,922,437 | B1 | 4/2011 | Loftin et al. |
| 7,926,660 | B2 | 4/2011 | Jones et al. |
| 7,935,041 | B2 | 5/2011 | Graham et al. |
| 7,942,291 | B2 | 5/2011 | Foster |
| 7,954,306 | B2 | 6/2011 | Gould |
| 7,959,063 | B2 | 6/2011 | McLeod |
| 7,967,171 | B2 | 6/2011 | Foster et al. |
| 7,980,390 | B2 | 7/2011 | Hession et al. |
| 7,980,432 | B2 | 7/2011 | Brannon et al. |
| 7,993,255 | B1 | 8/2011 | Herrin |
| 8,016,164 | B2 | 9/2011 | Montaner et al. |
| 8,024,910 | B2 | 9/2011 | Graham et al. |
| 8,025,763 | B2 | 9/2011 | Fugitt et al. |
| 8,028,861 | B2 | 10/2011 | Brouwer |
| 8,033,420 | B2 | 10/2011 | Roseblade et al. |
| 8,038,041 | B2 | 10/2011 | Skillin et al. |
| 8,046,192 | B2 | 10/2011 | McClain et al. |
| 8,056,721 | B2 | 11/2011 | Hession |
| D650,670 | S | 12/2011 | Dunwoody |
| D651,082 | S | 12/2011 | Dunwoody |
| 8,079,497 | B2 | 12/2011 | Brouwer |
| D653,110 | S | 1/2012 | Sweeton |
| 8,091,715 | B2 | 1/2012 | Roth |
| 8,096,437 | B1 | 1/2012 | Ryan |
| 8,100,262 | B2 | 1/2012 | Jones |
| 8,104,646 | B2 | 1/2012 | Foster et al. |
| 8,105,223 | B2 | 1/2012 | Graham et al. |
| D653,540 | S | 2/2012 | Sweeton |
| D653,541 | S | 2/2012 | Foster et al. |
| 8,109,382 | B2 | 2/2012 | Duperray |
| 8,113,416 | B2 | 2/2012 | Yan |
| D656,394 | S | 3/2012 | Smith |
| 8,128,547 | B2 | 3/2012 | Graham et al. |
| 8,128,776 | B2 | 3/2012 | Schuetz et al. |
| 8,132,671 | B2 | 3/2012 | Hession |
| 8,133,163 | B2 | 3/2012 | Strong et al. |
| 8,142,887 | B2 | 3/2012 | Fugitt et al. |
| 8,149,096 | B2 | 4/2012 | Metry et al. |
| 8,152,077 | B2 | 4/2012 | Marelli et al. |
| D659,464 | S | 5/2012 | Alberts |
| 8,177,698 | B2 | 5/2012 | Herrin |
| 8,177,699 | B1 | 5/2012 | Herrin |
| 8,187,420 | B2 | 5/2012 | Fugitt et al. |
| 8,190,289 | B2 | 5/2012 | Lockwood et al. |
| 8,201,755 | B2 | 6/2012 | Shanklin et al. |
| 8,206,136 | B2 | 6/2012 | Brouwer et al. |
| 8,215,520 | B2 | 7/2012 | Miller et al. |
| 8,225,933 | B2 | 7/2012 | Wade |
| 8,225,967 | B2 | 7/2012 | Dodd |
| 8,251,218 | B2 | 8/2012 | Gelardi et al. |
| D668,952 | S | 10/2012 | Auclair |
| 8,292,095 | B2 | 10/2012 | Howlett |
| 8,302,809 | B1 | 11/2012 | Bogdziewicz, III et al. |
| 8,302,824 | B2 | 11/2012 | Brannon et al. |
| 8,312,993 | B2 | 11/2012 | Sams et al. |
| 8,313,614 | B2 | 11/2012 | Fugitt et al. |
| 8,336,745 | B2 | 12/2012 | Brannon et al. |
| 8,342,335 | B2 | 1/2013 | Couture |
| 8,349,443 | B2 | 1/2013 | Fugitt et al. |
| 8,353,425 | B2 | 1/2013 | Lockwood et al. |
| 8,376,141 | B2 | 2/2013 | Couture |
| 8,381,925 | B2 | 2/2013 | Skillin et al. |
| 8,386,075 | B2 | 2/2013 | Lockwood et al. |
| 8,388,507 | B2 | 3/2013 | Herrin |
| 8,389,079 | B2 | 3/2013 | Babinsky et al. |
| 8,392,135 | B2 | 3/2013 | McClain et al. |
| 8,430,273 | B2 | 4/2013 | Brouwer |
| 8,444,004 | B1 | 5/2013 | Draganic |
| 8,448,815 | B2 | 5/2013 | Sholl et al. |
| 8,448,844 | B2 | 5/2013 | Yan |
| 8,453,920 | B2 | 6/2013 | Schemmel et al. |
| 8,469,241 | B2 | 6/2013 | Romanov et al. |

(56) References Cited

U.S. PATENT DOCUMENTS

| | | | |
|---|---|---|---|
| 8,469,291 | B2 | 6/2013 | Foster et al. |
| 8,471,668 | B2 | 6/2013 | Hsieh et al. |
| 8,485,391 | B2 | 7/2013 | Vlastakis et al. |
| 8,485,420 | B2 | 7/2013 | Barner |
| 8,496,162 | B2 | 7/2013 | Hettinger et al. |
| 8,500,946 | B2 | 8/2013 | Haraldsson |
| 8,505,778 | B2 | 8/2013 | Welp |
| 8,517,075 | B2 | 8/2013 | Shanton et al. |
| 8,517,221 | B2 | 8/2013 | Sweeton et al. |
| D689,735 | S | 9/2013 | Redfern |
| 8,523,025 | B2 | 9/2013 | Skillin |
| 8,534,970 | B2 | 9/2013 | Salo |
| 8,536,987 | B2 | 9/2013 | Metry et al. |
| 8,538,710 | B2 | 9/2013 | Todd et al. |
| 8,541,074 | B2 | 9/2013 | Babinsky et al. |
| 8,544,694 | B2 | 10/2013 | Waitz |
| 8,550,261 | B2 | 10/2013 | Loftin et al. |
| 8,561,798 | B2 | 10/2013 | Hession |
| D694,108 | S | 11/2013 | Dunn et al. |
| 8,579,778 | B2 | 11/2013 | Aganovic et al. |
| D695,611 | S | 12/2013 | Burleson, Jr. et al. |
| D695,626 | S | 12/2013 | Webster et al. |
| 8,604,653 | B2 | 12/2013 | Orlowski et al. |
| 8,607,982 | B2 | 12/2013 | Jones |
| 8,608,018 | B2 | 12/2013 | Babinsky et al. |
| D696,942 | S | 1/2014 | Kim |
| 8,622,282 | B2 | 1/2014 | Brundage et al. |
| 8,627,998 | B2 | 1/2014 | Martinez |
| D698,640 | S | 2/2014 | Buchanan et al. |
| D698,645 | S | 2/2014 | Hanks |
| D699,561 | S | 2/2014 | Buchanan et al. |
| D700,051 | S | 2/2014 | Driskell |
| D700,052 | S | 2/2014 | Sweeton |
| 8,646,650 | B2 | 2/2014 | Lockwood et al. |
| 8,647,717 | B2 | 2/2014 | Babinsky et al. |
| 8,651,304 | B2 | 2/2014 | Skillin et al. |
| 8,651,335 | B2 | 2/2014 | Faneca |
| 8,652,598 | B2 | 2/2014 | Babinsky et al. |
| 8,658,272 | B2 | 2/2014 | Bushhouse et al. |
| D701,121 | S | 3/2014 | McGeough |
| 8,664,812 | B2 | 3/2014 | Vicars et al. |
| 8,671,651 | B2 | 3/2014 | Poutot et al. |
| 8,672,189 | B2 | 3/2014 | Espinoza et al. |
| 8,673,398 | B2 | 3/2014 | Fugitt et al. |
| D701,700 | S | 4/2014 | Abdi et al. |
| D702,116 | S | 4/2014 | Buchanan et al. |
| D702,123 | S | 4/2014 | Sweeton |
| D703,047 | S | 4/2014 | Sweeton |
| 8,684,182 | B2 | 4/2014 | Bailey |
| 8,698,627 | B2 | 4/2014 | Londo et al. |
| 8,701,889 | B2 | 4/2014 | Sams et al. |
| 8,708,146 | B2 | 4/2014 | Falcon |
| 8,708,217 | B2 | 4/2014 | Boukredine |
| D705,649 | S | 5/2014 | Sweeton |
| D705,653 | S | 5/2014 | Sweeton |
| 8,733,070 | B2 | 5/2014 | Gould |
| 8,733,623 | B2 | 5/2014 | Beales |
| 8,757,380 | B2 | 6/2014 | Loftin |
| 8,763,888 | B2 | 7/2014 | Willman et al. |
| 8,770,397 | B2 | 7/2014 | Holley |
| 8,770,445 | B2 | 7/2014 | Welp |
| 8,777,093 | B2 | 7/2014 | Smith |
| 8,777,094 | B2 | 7/2014 | Strong et al. |
| 8,789,703 | B2 | 7/2014 | Couture |
| D710,697 | S | 8/2014 | Lind |
| 8,794,504 | B2 | 8/2014 | McLeod |
| 8,800,822 | B2 | 8/2014 | Good et al. |
| 8,800,823 | B2 | 8/2014 | Sweeton |
| 8,800,852 | B2 | 8/2014 | Schemmel et al. |
| 8,800,854 | B2 | 8/2014 | Chapman et al. |
| 8,814,010 | B2 | 8/2014 | Romanov et al. |
| 8,814,031 | B2 | 8/2014 | Graham et al. |
| 8,820,618 | B2 | 9/2014 | Smith |
| 8,827,142 | B2 | 9/2014 | Smith |
| 8,844,728 | B2 | 9/2014 | James et al. |
| 8,844,797 | B2 | 9/2014 | Smith |
| D714,656 | S | 10/2014 | White |
| D714,657 | S | 10/2014 | White |
| 8,852,528 | B2 | 10/2014 | Thomson et al. |
| 8,863,952 | B2 | 10/2014 | Bates et al. |
| 8,864,052 | B2 | 10/2014 | Foster et al. |
| D717,104 | S | 11/2014 | Redfern |
| 8,887,982 | B2 | 11/2014 | Smith et al. |
| 8,887,984 | B2 | 11/2014 | Bahr |
| 8,910,827 | B2 | 12/2014 | Lockwood |
| 8,916,636 | B2 | 12/2014 | Bushhouse et al. |
| 8,931,686 | B2 | 1/2015 | Brundage et al. |
| 8,936,180 | B2 | 1/2015 | Sell |
| 8,939,281 | B2 | 1/2015 | Matsuba et al. |
| 8,939,327 | B2 | 1/2015 | Faneca |
| 8,939,350 | B2 | 1/2015 | Valencia |
| 8,939,351 | B2 | 1/2015 | Goudreau et al. |
| 8,950,634 | B2 | 2/2015 | Boes et al. |
| 8,955,740 | B2 | 2/2015 | Magnell |
| 8,960,475 | B1 | 2/2015 | Peters et al. |
| 8,973,811 | B2 | 3/2015 | McLeod et al. |
| 8,979,093 | B2 | 3/2015 | Orlowski et al. |
| 8,985,401 | B2 | 3/2015 | Welp |
| 8,985,405 | B2 | 3/2015 | Wanbaugh |
| 8,985,431 | B2 | 3/2015 | Smith et al. |
| 8,991,603 | B2 | 3/2015 | Hession |
| 8,991,684 | B2 | 3/2015 | Mengistu et al. |
| D726,533 | S | 4/2015 | Northrup |
| D727,147 | S | 4/2015 | Boes et al. |
| 8,998,591 | B2 | 4/2015 | Han de Man |
| 9,004,344 | B2 | 4/2015 | Smith |
| 9,004,491 | B2 | 4/2015 | Orlowski et al. |
| 9,010,533 | B2 | 4/2015 | Psalidas et al. |
| 9,010,571 | B2 | 4/2015 | Bailey |
| 9,016,527 | B2 | 4/2015 | Faneca |
| 9,022,301 | B2 | 5/2015 | Sell et al. |
| 9,022,913 | B2 | 5/2015 | Graham et al. |
| 9,033,208 | B2 | 5/2015 | Martinez |
| 9,038,884 | B2 | 5/2015 | Bernstein |
| D730,732 | S | 6/2015 | Sweeton |
| D731,239 | S | 6/2015 | Rothfield et al. |
| D732,959 | S | 6/2015 | Branstad |
| D733,286 | S | 6/2015 | Patil |
| 9,045,250 | B2 | 6/2015 | Henderson et al. |
| 9,048,603 | B2 | 6/2015 | Vicars et al. |
| 9,052,994 | B2 | 6/2015 | Lockwood et al. |
| 9,061,786 | B2 | 6/2015 | Smith et al. |
| 9,061,792 | B2 | 6/2015 | Smith |
| 9,061,817 | B2 | 6/2015 | Lind |
| 9,062,777 | B2 | 6/2015 | Shanklin et al. |
| 9,071,092 | B2 | 6/2015 | Hoehle et al. |
| D734,642 | S | 7/2015 | Vasbinder et al. |
| 9,073,659 | B2 | 7/2015 | Smith |
| 9,073,661 | B2 | 7/2015 | Smith |
| 9,079,198 | B2 | 7/2015 | Romanov et al. |
| 9,090,037 | B2 | 7/2015 | Swenson |
| 9,090,115 | B2 | 7/2015 | Shields |
| D736,083 | S | 8/2015 | Hager |
| D736,097 | S | 8/2015 | Bailey et al. |
| D736,100 | S | 8/2015 | White et al. |
| D736,621 | S | 8/2015 | Ivancic |
| D737,139 | S | 8/2015 | Sokoly |
| 9,096,342 | B2 | 8/2015 | Smith et al. |
| 9,108,793 | B2 | 8/2015 | Northrup |
| 9,114,921 | B2 | 8/2015 | Smith |
| D737,690 | S | 9/2015 | Bailey et al. |
| D738,221 | S | 9/2015 | White |
| 9,119,488 | B2 | 9/2015 | Lockwood et al. |
| 9,136,050 | B2 | 9/2015 | Hsieh et al. |
| 9,149,982 | B2 | 10/2015 | Shanton et al. |
| 9,156,578 | B2 | 10/2015 | Smith |
| 9,162,792 | B2 | 10/2015 | James et al. |
| 9,174,407 | B2 | 11/2015 | Herrin |
| 9,174,776 | B1 | 11/2015 | DeTolla |
| 9,174,780 | B2 | 11/2015 | Gelardi et al. |
| 9,174,784 | B2 | 11/2015 | Bakx et al. |
| 9,174,785 | B2 | 11/2015 | Gelardi et al. |
| 9,180,068 | B2 | 11/2015 | Loftin |
| 9,181,025 | B2 | 11/2015 | Graham et al. |

(56) References Cited

U.S. PATENT DOCUMENTS

| | | | |
|---|---|---|---|
| 9,181,658 | B2 | 11/2015 | Bushhouse et al. |
| 9,187,219 | B2 | 11/2015 | Brannon et al. |
| 9,194,732 | B2 | 11/2015 | Tarozzi et al. |
| D746,135 | S | 12/2015 | Lind |
| 9,199,775 | B2 | 12/2015 | Bates |
| 9,199,783 | B2 | 12/2015 | Wanbaugh et al. |
| 9,206,553 | B2 | 12/2015 | Bushhouse et al. |
| 9,206,797 | B2 | 12/2015 | Han de Man et al. |
| 9,211,986 | B2 | 12/2015 | Auclair |
| 9,212,842 | B2 | 12/2015 | Vasbinder et al. |
| D746,626 | S | 1/2016 | Lagsdin |
| D746,631 | S | 1/2016 | Tseng |
| D746,682 | S | 1/2016 | Trombetta |
| 9,227,027 | B2 | 1/2016 | Keenan |
| 9,227,753 | B2 | 1/2016 | Saulas et al. |
| 9,227,769 | B2 | 1/2016 | Skillin et al. |
| 9,242,758 | B2 | 1/2016 | Brundage et al. |
| 9,259,913 | B2 | 2/2016 | Ellefson |
| 9,260,232 | B2 | 2/2016 | Kooc et al. |
| 9,266,135 | B2 | 2/2016 | Harms et al. |
| 9,266,656 | B2 | 2/2016 | Walling et al. |
| D751,380 | S | 3/2016 | Torrison et al. |
| D751,381 | S | 3/2016 | Torrison et al. |
| D751,382 | S | 3/2016 | Torrison et al. |
| D751,383 | S | 3/2016 | Torrison et al. |
| D751,898 | S | 3/2016 | D'Anglade |
| 9,283,582 | B2 | 3/2016 | Han de Man |
| 9,284,089 | B2 | 3/2016 | Ikeda |
| 9,296,509 | B2 | 3/2016 | McLeod |
| 9,298,706 | B2 | 3/2016 | Magnell |
| 9,315,310 | B2 | 4/2016 | Bailey |
| 9,315,314 | B2 | 4/2016 | Sell |
| 9,320,365 | B2 | 4/2016 | Fortuna et al. |
| D755,047 | S | 5/2016 | Boes et al. |
| 9,334,097 | B2 | 5/2016 | Skillin et al. |
| 9,339,831 | B2 | 5/2016 | Han de Man |
| 9,340,368 | B2 | 5/2016 | Ellefson et al. |
| 9,346,596 | B2 | 5/2016 | Hanks et al. |
| 9,346,597 | B2 | 5/2016 | Bradfield |
| 9,359,102 | B2 | 6/2016 | Martinez |
| 9,359,106 | B2 | 6/2016 | Bogdziewicz, III et al. |
| 9,371,165 | B2 | 6/2016 | Brannon et al. |
| 9,376,246 | B2 | 6/2016 | Jones et al. |
| D760,598 | S | 7/2016 | White et al. |
| D762,116 | S | 7/2016 | Prendergast-Kelly et al. |
| 9,382,041 | B2 | 7/2016 | Couture |
| 9,387,149 | B2 | 7/2016 | Jones et al. |
| 9,387,500 | B2 | 7/2016 | Good et al. |
| 9,387,959 | B2 | 7/2016 | Dunwoody |
| 9,387,965 | B2 | 7/2016 | Skillin et al. |
| 9,394,087 | B2 | 7/2016 | Phillips et al. |
| 9,395,225 | B2 | 7/2016 | Skillin |
| D762,484 | S | 8/2016 | White |
| 9,409,195 | B2 | 8/2016 | DeJong et al. |
| 9,409,367 | B2 | 8/2016 | Graham et al. |
| 9,409,669 | B2 | 8/2016 | Bahr |
| 9,415,895 | B2 | 8/2016 | James et al. |
| 9,422,093 | B2 | 8/2016 | Merzeau |
| 9,422,101 | B2 | 8/2016 | Wu et al. |
| 9,428,299 | B2 | 8/2016 | Mengistu et al. |
| D766,717 | S | 9/2016 | Sheikh |
| D767,330 | S | 9/2016 | Skolfield |
| 9,434,520 | B2 | 9/2016 | Bates |
| 9,452,861 | B2 | 9/2016 | Smith |
| D767,989 | S | 10/2016 | Nietert et al. |
| 9,457,939 | B1 | 10/2016 | Peters |
| 9,469,078 | B2 | 10/2016 | Aganovic et al. |
| 9,469,432 | B2 | 10/2016 | Aguirre |
| 9,475,604 | B2 | 10/2016 | Smith |
| 9,475,606 | B2 | 10/2016 | Ball et al. |
| 9,475,622 | B2 | 10/2016 | Skillin et al. |
| 9,475,635 | B2 | 10/2016 | Driskell et al. |
| 9,483,896 | B2 | 11/2016 | Lockwood et al. |
| 9,487,315 | B2 | 11/2016 | Poutot et al. |
| 9,493,268 | B2 | 11/2016 | Loftin et al. |
| 9,505,016 | B2 | 11/2016 | Thiede et al. |
| 9,505,520 | B2 | 11/2016 | Baker |
| D774,887 | S | 12/2016 | Torrison et al. |
| 9,517,498 | B2 | 12/2016 | Siles et al. |
| 9,517,865 | B2 | 12/2016 | Albers et al. |
| 9,523,596 | B2 | 12/2016 | Skillin et al. |
| 9,525,327 | B2 | 12/2016 | Orlowski et al. |
| 9,527,642 | B2 | 12/2016 | Ramsuer et al. |
| 9,533,817 | B2 | 1/2017 | Smallwood |
| 9,546,035 | B2 | 1/2017 | Hession |
| 9,555,426 | B2 | 1/2017 | Skillin et al. |
| 9,561,147 | B2 | 2/2017 | Todd et al. |
| 9,566,756 | B2 | 2/2017 | Brundage |
| 9,567,709 | B2 | 2/2017 | Fugitt et al. |
| 9,573,336 | B2 | 2/2017 | Magnell et al. |
| 9,573,720 | B2 | 2/2017 | Dixon et al. |
| 9,576,710 | B2 | 2/2017 | Hsieh et al. |
| 9,579,675 | B2 | 2/2017 | Foster et al. |
| 9,580,201 | B2 | 2/2017 | Willman et al. |
| 9,586,742 | B2 | 3/2017 | Zacherle et al. |
| 9,586,748 | B2 | 3/2017 | Le |
| 9,592,942 | B2 | 3/2017 | Walling |
| 9,598,225 | B2 | 3/2017 | Patil et al. |
| 9,603,467 | B2 | 3/2017 | Lockwood |
| 9,604,767 | B2 | 3/2017 | Ramsuer |
| 9,604,768 | B2 | 3/2017 | Ramsuer et al. |
| D784,808 | S | 4/2017 | Berroa Garcia |
| 9,614,339 | B2 | 4/2017 | Vicars et al. |
| 9,617,052 | B2 | 4/2017 | McIntire et al. |
| 9,630,738 | B2 | 4/2017 | Loftin et al. |
| 9,634,547 | B1 | 4/2017 | Orlowski et al. |
| D787,263 | S | 5/2017 | Baron et al. |
| 9,643,353 | B2 | 5/2017 | Wade et al. |
| 9,656,790 | B2 | 5/2017 | Smith |
| 9,670,621 | B2 | 6/2017 | Pang et al. |
| 9,676,534 | B2 | 6/2017 | Psalidas et al. |
| 9,689,115 | B2 | 6/2017 | Meyers |
| D792,738 | S | 7/2017 | Savenok |
| 9,701,087 | B2 | 7/2017 | Graham et al. |
| 9,701,088 | B2 | 7/2017 | Strong et al. |
| 9,701,451 | B2 | 7/2017 | Skillin et al. |
| 9,707,730 | B1 | 7/2017 | Calvert et al. |
| 9,708,093 | B2 | 7/2017 | Romanov et al. |
| 9,714,132 | B2 | 7/2017 | Welp |
| 9,718,578 | B1 | 8/2017 | Smith |
| 9,731,861 | B2 | 8/2017 | Cram |
| 9,732,473 | B2 | 8/2017 | Fugitt et al. |
| 9,732,649 | B2 | 8/2017 | Hiltzik et al. |
| 9,738,436 | B2 | 8/2017 | Sell |
| 9,764,524 | B2 | 9/2017 | Armstrong et al. |
| 9,764,526 | B2 | 9/2017 | Aganovic et al. |
| 9,771,688 | B2 | 9/2017 | Pang et al. |
| 9,782,021 | B2 | 10/2017 | Shaffer |
| 9,783,334 | B2 | 10/2017 | McLeod et al. |
| 9,789,993 | B2 | 10/2017 | Smith et al. |
| 9,790,013 | B2 | 10/2017 | Loftin et al. |
| 9,796,501 | B2 | 10/2017 | Smith et al. |
| 9,805,860 | B2 | 10/2017 | Hsieh et al. |
| 9,809,332 | B2 | 11/2017 | Valencia et al. |
| 9,809,346 | B2 | 11/2017 | Valencia |
| 9,815,586 | B2 | 11/2017 | Graham et al. |
| 9,821,939 | B2 | 11/2017 | Blin |
| 9,827,581 | B2 | 11/2017 | Good et al. |
| 9,828,131 | B2 | 11/2017 | James et al. |
| 9,828,132 | B2 | 11/2017 | Jones et al. |
| 9,831,739 | B2 | 11/2017 | Tejano et al. |
| 9,839,929 | B2 | 12/2017 | Deman |
| 9,845,183 | B2 | 12/2017 | Bailey |
| 9,846,066 | B2 | 12/2017 | Falcon et al. |
| 9,850,022 | B2 | 12/2017 | Martinez |
| D807,746 | S | 1/2018 | Fleming |
| 9,863,094 | B2 | 1/2018 | Pang et al. |
| 9,868,562 | B2 | 1/2018 | McDonnell et al. |
| 9,878,512 | B2 | 1/2018 | Graham et al. |
| 9,884,335 | B2 | 2/2018 | Marelli |
| 9,884,706 | B1 | 2/2018 | Skillin et al. |
| 9,889,982 | B2 | 2/2018 | Falcon et al. |
| 9,895,737 | B2 | 2/2018 | Caunter et al. |
| D811,811 | S | 3/2018 | Wachter et al. |

(56) References Cited

U.S. PATENT DOCUMENTS

| | | | |
|---|---|---|---|
| 9,908,304 | B2 | 3/2018 | Aganovic et al. |
| 9,908,660 | B2 | 3/2018 | James et al. |
| 9,914,573 | B2 | 3/2018 | Billadeau et al. |
| 9,919,830 | B2 | 3/2018 | Smith et al. |
| 9,919,861 | B2 | 3/2018 | Bolognia et al. |
| 9,920,485 | B2 | 3/2018 | Parker et al. |
| D815,890 | S | 4/2018 | Boroski |
| 9,937,509 | B2 | 4/2018 | De Jong |
| 9,938,040 | B2 | 4/2018 | Buscema |
| 9,938,299 | B2 | 4/2018 | Selnick et al. |
| 9,945,371 | B2 | 4/2018 | De Regt |
| D816,500 | S | 5/2018 | Torrison et al. |
| 9,974,391 | B2 | 5/2018 | Wan |
| 9,975,130 | B2 | 5/2018 | DeJong et al. |
| D821,658 | S | 6/2018 | Danenberg et al. |
| 9,987,641 | B2 | 6/2018 | Sell |
| 9,988,166 | B2 | 6/2018 | Avril et al. |
| 9,994,344 | B2 | 6/2018 | Buscema et al. |
| 9,994,352 | B2 | 6/2018 | Smith |
| 9,994,353 | B2 | 6/2018 | Patwardhan et al. |
| 9,994,356 | B2 | 6/2018 | Couture |
| 10,000,889 | B2 | 6/2018 | Hart et al. |
| 10,010,897 | B2 | 7/2018 | Espinoza |
| 10,022,004 | B2 | 7/2018 | Taormina et al. |
| 10,029,836 | B2 | 7/2018 | Danenberg et al. |
| 10,040,596 | B2 | 8/2018 | Leite |
| 10,052,837 | B2 | 8/2018 | Graham et al. |
| 10,053,271 | B2 | 8/2018 | Psalidas et al. |
| 10,058,479 | B2 | 8/2018 | O'Dwyer et al. |
| 10,060,075 | B2 | 8/2018 | Hart et al. |
| D828,158 | S | 9/2018 | Manis |
| 10,076,459 | B2 | 9/2018 | Todd et al. |
| 10,076,887 | B2 | 9/2018 | Aganovic et al. |
| 10,086,579 | B2 | 10/2018 | Armstrong et al. |
| 10,086,961 | B2 | 10/2018 | Bonnain et al. |
| 10,093,446 | B2 | 10/2018 | Brundage |
| 10,099,833 | B2 | 10/2018 | Saulas et al. |
| 10,106,289 | B2 | 10/2018 | Martinez |
| 10,106,290 | B2 | 10/2018 | Couture |
| 10,106,300 | B2 | 10/2018 | Brannon et al. |
| 10,112,206 | B2 | 10/2018 | Espinoza |
| 10,113,541 | B2 | 10/2018 | Han de Man et al. |
| 10,118,359 | B2 | 11/2018 | Herrin |
| 10,118,726 | B2 | 11/2018 | James et al. |
| 10,124,357 | B2 | 11/2018 | Good et al. |
| 10,159,997 | B2 | 12/2018 | Foster et al. |
| 10,159,998 | B2 | 12/2018 | Skillin et al. |
| D836,972 | S | 1/2019 | Baron et al. |
| 10,166,563 | B2 | 1/2019 | Espinoza |
| 10,173,804 | B2 | 1/2019 | Zacherle |
| 10,173,820 | B2 | 1/2019 | Patwardhan |
| 10,196,160 | B2 | 2/2019 | Bonnain et al. |
| 10,201,821 | B2 | 2/2019 | Brannon et al. |
| 10,214,333 | B2 | 2/2019 | Ball et al. |
| D842,118 | S | 3/2019 | Ramsuer et al. |
| 10,220,976 | B2 | 3/2019 | Zacherle |
| 10,220,995 | B2 | 3/2019 | Zacherle |
| 10,226,783 | B2 | 3/2019 | Han de Man |
| 10,228,272 | B2 | 3/2019 | A. Moreno Aparicio et al. |
| 10,233,010 | B2 | 3/2019 | Sell |
| 10,247,592 | B2 | 4/2019 | Falcon et al. |
| 10,253,458 | B2 | 4/2019 | Pang et al. |
| 10,259,611 | B2 | 4/2019 | Grace et al. |
| 10,260,038 | B2 | 4/2019 | Swee et al. |
| 10,265,919 | B2 | 4/2019 | Graham et al. |
| 10,270,320 | B1 | 4/2019 | Orlowski et al. |
| 10,272,459 | B2 | 4/2019 | Hohmann et al. |
| 10,273,043 | B2 | 4/2019 | Couture |
| 10,273,069 | B2 | 4/2019 | Bailey |
| D849,536 | S | 5/2019 | Trombetta |
| 10,279,951 | B2 | 5/2019 | Walling et al. |
| 10,280,820 | B2 | 5/2019 | Hiltzik et al. |
| 10,293,285 | B2 | 5/2019 | Ben-Ezra |
| 10,301,061 | B2 | 5/2019 | Walling et al. |
| 10,301,091 | B2 | 5/2019 | Ramsuer et al. |
| D850,848 | S | 6/2019 | Wachter et al. |
| 10,312,731 | B2 | 6/2019 | Lazo et al. |
| 10,323,553 | B2 | 6/2019 | Hiltzik et al. |
| 10,329,055 | B2 | 6/2019 | Combe |
| 10,336,049 | B2 | 7/2019 | Shanton et al. |
| 10,336,501 | B2 | 7/2019 | Smith |
| 10,343,801 | B2 | 7/2019 | Maxwell et al. |
| 10,343,829 | B2 | 7/2019 | Zacherle et al. |
| 10,350,849 | B2 | 7/2019 | Graham et al. |
| 10,358,280 | B2 | 7/2019 | Falcon et al. |
| 10,360,566 | B2 | 7/2019 | Brown et al. |
| 10,365,140 | B2 | 7/2019 | Koster et al. |
| 10,369,580 | B2 | 8/2019 | Bailey et al. |
| 10,377,523 | B2 | 8/2019 | Hayslette et al. |
| 10,384,223 | B2 | 8/2019 | Espinoza |
| 10,392,166 | B2 | 8/2019 | Skillin et al. |
| D859,153 | S | 9/2019 | Ramsuer et al. |
| D859,154 | S | 9/2019 | Skillin |
| 10,399,758 | B2 | 9/2019 | Vercoe et al. |
| 10,406,536 | B2 | 9/2019 | Romanov et al. |
| 10,407,227 | B2 | 9/2019 | Ikeda |
| 10,413,918 | B2 | 9/2019 | Sell |
| 10,414,538 | B2 | 9/2019 | Brundage et al. |
| 10,414,557 | B2 | 9/2019 | Skillin et al. |
| 10,420,853 | B2 | 9/2019 | Harrigan et al. |
| 10,421,090 | B2 | 9/2019 | DeJong et al. |
| 10,421,576 | B2 | 9/2019 | Couture |
| 10,421,598 | B2 | 9/2019 | Sell |
| 10,422,261 | B2 | 9/2019 | Hiltzik et al. |
| 10,457,439 | B2 | 10/2019 | Buscema |
| D866,248 | S | 11/2019 | Baron et al. |
| D866,336 | S | 11/2019 | Ramsuer |
| 10,471,452 | B2 | 11/2019 | Skillin et al. |
| 10,472,122 | B2 | 11/2019 | Aguirre |
| 10,472,151 | B2 | 11/2019 | Ball et al. |
| 10,479,575 | B2 | 11/2019 | Danenberg et al. |
| 10,479,578 | B2 | 11/2019 | Zacherle et al. |
| 10,486,176 | B2 | 11/2019 | Sell |
| 10,494,152 | B2 | 12/2019 | Ramsey |
| 10,519,604 | B2 | 12/2019 | Pang et al. |
| D871,906 | S | 1/2020 | Ramsey |
| 10,524,588 | B2 | 1/2020 | Pratsch |
| 10,526,107 | B2 | 1/2020 | Couture |
| 10,538,374 | B2 | 1/2020 | Hayter et al. |
| 10,543,954 | B2 | 1/2020 | Couture |
| 10,549,289 | B2 | 2/2020 | Romanov et al. |
| 10,556,396 | B2 | 2/2020 | Couture et al. |
| 10,562,255 | B2 | 2/2020 | Aganovic et al. |
| 10,562,660 | B2 | 2/2020 | Vasbinder |
| 10,562,685 | B2 | 2/2020 | Blin |
| 10,568,443 | B2 | 2/2020 | Hampton |
| 10,568,464 | B2 | 2/2020 | Koch et al. |
| 10,569,947 | B2 | 2/2020 | Ball et al. |
| D879,608 | S | 3/2020 | Stanmen et al. |
| 10,577,160 | B2 | 3/2020 | Zacherle |
| 10,582,787 | B2 | 3/2020 | Panek et al. |
| 10,589,902 | B2 | 3/2020 | Carreiro |
| 10,595,685 | B2 | 3/2020 | Falcon et al. |
| 10,596,852 | B2 | 3/2020 | Brantley et al. |
| 10,617,233 | B2 | 4/2020 | Ertl |
| 10,618,683 | B2 | 4/2020 | Jones |
| 10,619,306 | B2 | 4/2020 | Fugitt et al. |
| 10,633,152 | B2 | 4/2020 | Billadeau et al. |
| RE48,009 | E | 5/2020 | Loftin et al. |
| D883,579 | S | 5/2020 | Danenberg et al. |
| 10,646,888 | B2 | 5/2020 | Good et al. |
| 10,654,644 | B2 | 5/2020 | Sell |
| 10,655,277 | B2 | 5/2020 | Bhardwaj et al. |
| 10,655,998 | B2 | 5/2020 | Moreno et al. |
| 10,661,942 | B2 | 5/2020 | McCarthy |
| 10,668,492 | B2 | 6/2020 | Brannon et al. |
| 10,669,075 | B2 | 6/2020 | Robles et al. |
| 10,676,250 | B2 | 6/2020 | Sims et al. |
| 10,696,442 | B2 | 6/2020 | Sin |
| 10,704,200 | B2 | 7/2020 | Pang et al. |
| 10,706,750 | B2 | 7/2020 | Ertl |
| 10,710,767 | B2 | 7/2020 | Merzeau |
| 10,710,781 | B2 | 7/2020 | Battaglia et al. |
| 10,710,785 | B2 | 7/2020 | Patwardhan |

(56) References Cited

U.S. PATENT DOCUMENTS

| | | | |
|---|---|---|---|
| 10,718,651 | B2 | 7/2020 | Falcon et al. |
| D894,005 | S | 8/2020 | Ramsuer et al. |
| 10,730,675 | B2 | 8/2020 | Bates et al. |
| 10,737,828 | B2 | 8/2020 | Ertl |
| 10,745,170 | B2 | 8/2020 | Couture et al. |
| 10,759,555 | B2 | 9/2020 | Buscema et al. |
| 10,760,218 | B2 | 9/2020 | Yang et al. |
| 10,773,028 | B2 | 9/2020 | Keenan |
| 10,773,269 | B2 | 9/2020 | De Jong |
| 10,773,482 | B2 | 9/2020 | Strong et al. |
| 10,773,850 | B2 | 9/2020 | Couture |
| 10,773,870 | B2 | 9/2020 | Ikeda |
| 10,786,964 | B2 | 9/2020 | Graham et al. |
| 10,800,572 | B2 | 10/2020 | Gaidaeva et al. |
| 10,807,769 | B2 | 10/2020 | Ramsuer et al. |
| 10,815,022 | B2 | 10/2020 | Cline et al. |
| D900,605 | S | 11/2020 | Li |
| 10,821,698 | B2 | 11/2020 | Graham et al. |
| 10,822,137 | B2 | 11/2020 | Smith |
| 10,829,250 | B2 | 11/2020 | Graham et al. |
| 10,836,532 | B2 | 11/2020 | Djokovic et al. |
| 10,836,550 | B2 | 11/2020 | Zacherle |
| 10,843,217 | B2 | 11/2020 | Moreno et al. |
| 10,844,543 | B2 | 11/2020 | Pang et al. |
| D905,552 | S | 12/2020 | Milbrandt et al. |
| D906,041 | S | 12/2020 | Dai |
| 10,850,902 | B2 | 12/2020 | Blin |
| 10,858,142 | B2 | 12/2020 | Boukredine |
| 10,858,144 | B2 | 12/2020 | Sin |
| 10,858,163 | B2 | 12/2020 | Vercoe et al. |
| 10,858,784 | B2 | 12/2020 | Fugitt et al. |
| 10,865,010 | B2 | 12/2020 | Brundage et al. |
| 10,870,122 | B2 | 12/2020 | DeJong et al. |
| 10,870,523 | B2 | 12/2020 | Neale |
| D907,431 | S | 1/2021 | Friedman |
| 10,882,657 | B2 | 1/2021 | Couture |
| 10,889,405 | B2 | 1/2021 | Bojie |
| 10,894,628 | B2 | 1/2021 | Buscema |
| 10,894,646 | B2 | 1/2021 | Simpkins |
| 10,899,101 | B2 | 1/2021 | Graham et al. |
| 10,899,168 | B2 | 1/2021 | Madan |
| D909,323 | S | 2/2021 | Yoshida |
| 10,905,260 | B2 | 2/2021 | Hara et al. |
| 10,913,569 | B2 | 2/2021 | Graham et al. |
| 10,919,663 | B2 | 2/2021 | Jones |
| 10,940,494 | B2 | 3/2021 | Romanov et al. |
| 10,940,974 | B2 | 3/2021 | Bradford et al. |
| 10,954,018 | B2 | 3/2021 | Benterman et al. |
| 10,954,026 | B2 | 3/2021 | Simpkins et al. |
| 10,960,342 | B2 | 3/2021 | Hiltzik et al. |
| 10,961,659 | B2 | 3/2021 | Moynihan et al. |
| 10,961,663 | B2 | 3/2021 | Bushhouse et al. |
| D917,282 | S | 4/2021 | Albright et al. |
| 10,975,520 | B2 | 4/2021 | Hart et al. |
| 10,981,711 | B2 | 4/2021 | Smith |
| 10,987,889 | B2 | 4/2021 | Graham et al. |
| 10,988,281 | B2 | 4/2021 | McCarthy |
| 10,994,295 | B2 | 5/2021 | Ramsuer |
| 11,001,026 | B2 | 5/2021 | Graham et al. |
| 11,007,546 | B2 | 5/2021 | Hohmann et al. |
| 11,010,769 | B2 | 5/2021 | Brown et al. |
| 11,014,704 | B1 | 5/2021 | Beales |
| 11,014,726 | B2 | 5/2021 | Peeler et al. |
| D920,809 | S | 6/2021 | Chesnet et al. |
| D921,493 | S | 6/2021 | Chesnet et al. |
| 11,033,120 | B2 | 6/2021 | Frost |
| 11,059,252 | B2 | 7/2021 | Graham et al. |
| 11,066,208 | B2 | 7/2021 | Simpkins et al. |
| 11,072,456 | B2 | 7/2021 | Zacherle |
| 11,072,474 | B2 | 7/2021 | Peeler et al. |
| D926,574 | S | 8/2021 | Yamada |
| D926,575 | S | 8/2021 | Yamada |
| 11,077,980 | B2 | 8/2021 | Hwang |
| 11,083,204 | B2 | 8/2021 | Smith |
| 11,084,639 | B2 | 8/2021 | Ball |
| 11,084,640 | B2 | 8/2021 | Kooc et al. |
| D930,476 | S | 9/2021 | Bontrager et al. |
| D944,643 | S | 3/2022 | D'Amato |
| D956,562 | S | 7/2022 | Zhang et al. |
| D957,938 | S | 7/2022 | Noh |
| D959,982 | S | 8/2022 | Xie |
| D960,707 | S | 8/2022 | Yamada |
| D961,386 | S | 8/2022 | Luburic et al. |
| 2002/0168453 | A1 | 11/2002 | McCutchan |
| 2004/0159080 | A1 | 8/2004 | Stewart et al. |
| 2004/0173560 | A1 | 9/2004 | Chupak |
| 2006/0086743 | A1 | 4/2006 | Tavlarides |
| 2006/0169707 | A1 | 8/2006 | Walz et al. |
| 2006/0255052 | A1 | 11/2006 | Svitak |
| 2007/0205198 | A1 | 9/2007 | Huber |
| 2008/0041869 | A1 | 2/2008 | Backaert |
| 2008/0185382 | A1 | 8/2008 | Romley et al. |
| 2009/0194542 | A1 | 8/2009 | Hong |
| 2009/0236353 | A1 | 9/2009 | Martin et al. |
| 2010/0089252 | A1 | 4/2010 | Hong |
| 2010/0098816 | A1 | 4/2010 | Jain |
| 2010/0108182 | A1 | 5/2010 | Noonan |
| 2011/0101008 | A1 | 5/2011 | Draganic, III |
| 2011/0108583 | A1 | 5/2011 | Sell et al. |
| 2011/0173930 | A1 | 7/2011 | Poutot et al. |
| 2011/0204128 | A1 | 8/2011 | Hettinger et al. |
| 2012/0024870 | A1 | 2/2012 | Buisson et al. |
| 2012/0024873 | A1 | 2/2012 | Roseblade et al. |
| 2012/0055981 | A1 | 3/2012 | Parks et al. |
| 2012/0074157 | A1 | 3/2012 | Dunwoody |
| 2012/0292867 | A1 | 11/2012 | Allam et al. |
| 2013/0134119 | A1 | 5/2013 | Loftin et al. |
| 2013/0216824 | A1 | 8/2013 | Wade et al. |
| 2014/0061252 | A1 | 3/2014 | Sweeton et al. |
| 2014/0061253 | A1 | 3/2014 | Sweeton |
| 2014/0070030 | A1 | 3/2014 | Harms et al. |
| 2014/0076922 | A1 | 3/2014 | Binshtok et al. |
| 2014/0103044 | A1 | 4/2014 | Ramsey et al. |
| 2014/0110440 | A1 | 4/2014 | Good et al. |
| 2014/0113787 | A1 | 4/2014 | Aganovic et al. |
| 2014/0141952 | A1 | 5/2014 | Graham et al. |
| 2014/0156064 | A1 | 6/2014 | Crawford et al. |
| 2014/0156298 | A1 | 6/2014 | Crawford et al. |
| 2014/0158574 | A1 | 6/2014 | Forbes |
| 2014/0262839 | A1 | 9/2014 | Le et al. |
| 2014/0298641 | A1 | 10/2014 | Siles et al. |
| 2014/0305075 | A1 | 10/2014 | Bonnain |
| 2014/0326631 | A1 | 11/2014 | Cotie et al. |
| 2014/0335248 | A1 | 11/2014 | Winstanley et al. |
| 2014/0373486 | A1 | 12/2014 | Thomsen et al. |
| 2015/0001257 | A1 | 1/2015 | Sell |
| 2015/0086319 | A1 | 3/2015 | Martini |
| 2015/0101747 | A1 | 4/2015 | Parks et al. |
| 2015/0108146 | A1 | 4/2015 | Jameson et al. |
| 2015/0136776 | A1 | 5/2015 | Chasteen et al. |
| 2015/0141229 | A1 | 5/2015 | Flagg et al. |
| 2015/0144688 | A1 | 5/2015 | Bates et al. |
| 2015/0203266 | A1 | 7/2015 | Wu et al. |
| 2015/0225155 | A1 | 8/2015 | Ikeda |
| 2015/0263663 | A1 | 9/2015 | Lazo et al. |
| 2015/0307248 | A1 | 10/2015 | Patwardhan et al. |
| 2015/0336729 | A1 | 11/2015 | McInntire |
| 2015/0344162 | A1 | 12/2015 | Bonnain et al. |
| 2015/0344205 | A1 | 12/2015 | Lebras et al. |
| 2015/0344207 | A1 | 12/2015 | Zacherle |
| 2016/0001917 | A1 | 1/2016 | Gould et al. |
| 2016/0001948 | A1 | 1/2016 | Collins et al. |
| 2016/0009439 | A1 | 1/2016 | Armstrong et al. |
| 2016/0016713 | A1 | 1/2016 | Wu et al. |
| 2016/0039551 | A1 | 2/2016 | Aganovic et al. |
| 2016/0039586 | A1 | 2/2016 | Merzeau |
| 2016/0068290 | A1 | 3/2016 | Bonnain et al. |
| 2016/0122070 | A1 | 5/2016 | Peeler |
| 2016/0130060 | A1 | 5/2016 | Ball |
| 2016/0152391 | A1 | 6/2016 | Ramsuer et al. |
| 2016/0159516 | A1 | 6/2016 | Ball |
| 2016/0185484 | A1 | 6/2016 | Bakx |
| 2016/0228860 | A1 | 8/2016 | Thomson et al. |
| 2016/0229616 | A1 | 8/2016 | Loftin et al. |

(56) References Cited

U.S. PATENT DOCUMENTS

2016/0297587 A1 10/2016 Garcia et al.
2016/0311578 A1 10/2016 Ramsuer
2016/0318651 A1 11/2016 Jones et al.
2016/0347524 A1 12/2016 Jones et al.
2017/0043495 A1 2/2017 Wade et al.
2017/0197241 A1 7/2017 Ellefson
2017/0197770 A1 7/2017 Peeler et al.
2017/0217630 A1 8/2017 Ramsuer et al.
2017/0225859 A1 8/2017 Hayter et al.
2017/0246401 A1 8/2017 Keenan
2017/0253366 A1 9/2017 James et al.
2017/0313464 A1 11/2017 McCarthy et al.
2017/0333284 A1 11/2017 Jones
2017/0361971 A1 12/2017 Jentzsch et al.
2018/0009593 A1 1/2018 Haschke et al.
2018/0012259 A1 1/2018 Lazo
2018/0016440 A1 1/2018 Fugitt et al.
2018/0029768 A1 2/2018 Blin
2018/0047059 A1 2/2018 Lazo et al.
2018/0128667 A1 5/2018 Loftin
2018/0134443 A1 5/2018 Ball et al.
2018/0141734 A1 5/2018 Kooc et al.
2018/0194508 A1 7/2018 Simpson
2018/0221936 A1 8/2018 Scott
2018/0243171 A1 8/2018 Knotts et al.
2018/0244436 A1 8/2018 Smallwood
2018/0245291 A1 8/2018 Pang et al.
2018/0257349 A1 9/2018 Bhardwaj et al.
2018/0293919 A1 10/2018 Ertl et al.
2018/0305100 A1 10/2018 Blin
2018/0334300 A1 11/2018 Collins et al.
2018/0346181 A1 12/2018 Patwardhan
2018/0346215 A1 12/2018 Zacherle et al.
2019/0000243 A1 1/2019 Ertl
2019/0001606 A1 1/2019 Polster
2019/0009970 A1 1/2019 Yang et al.
2019/0039775 A1 2/2019 Swarnaraj et al.
2019/0055071 A1 2/2019 Hayter et al.
2019/0112095 A1 4/2019 Swarnaraj et al.
2019/0112100 A1 4/2019 Scott
2019/0118995 A1 4/2019 Page
2019/0119854 A1 4/2019 Knox et al.
2019/0135482 A1 5/2019 Pratsch et al.
2019/0135512 A1 5/2019 Kooc et al.
2019/0144184 A1 5/2019 Zacherle
2019/0161248 A1 5/2019 Ramsey et al.
2019/0202593 A1 7/2019 Merzeau et al.
2019/0218719 A1 7/2019 Bushhouse et al.
2019/0225365 A1 7/2019 Couture et al.
2019/0233145 A1 8/2019 Kooc et al.
2019/0233159 A1 8/2019 Jones et al.
2019/0241327 A1 8/2019 Loveridge
2019/0248536 A1 8/2019 Foushee
2019/0248537 A1 8/2019 Valencia
2019/0248557 A1 8/2019 James et al.
2019/0248568 A1 8/2019 Haschke
2019/0256267 A1 8/2019 Merzeau et al.
2019/0257034 A1 8/2019 Pang et al.
2019/0283947 A1 9/2019 Merzeau
2019/0300231 A1 10/2019 Zacherle et al.
2019/0300255 A1 10/2019 Ikeda
2019/0300256 A1 10/2019 Loftin
2019/0308381 A1 10/2019 Graham et al.
2019/0315512 A1 10/2019 Smith et al.
2019/0315554 A1 10/2019 Haschke et al.
2019/0322412 A1 10/2019 Couture et al.
2019/0329928 A1 10/2019 Linvill et al.
2019/0329929 A1 10/2019 Pang et al.
2019/0352064 A1 11/2019 Lachmann et al.
2019/0367210 A1 12/2019 Smith
2019/0382157 A1 12/2019 Simpkins et al.
2020/0002048 A1 1/2020 Shaffer
2020/0031516 A1 1/2020 Kuhn
2020/0037787 A1 2/2020 Pratsch
2020/0039712 A1 2/2020 Danenberg et al.
2020/0087025 A1 3/2020 Beavor
2020/0095013 A1 3/2020 Dixon
2020/0095015 A1 3/2020 Dixon
2020/0115098 A1 4/2020 Burks
2020/0140136 A1 5/2020 Tripp et al.
2020/0140169 A1 5/2020 Zacherle et al.
2020/0143711 A1 5/2020 Zacherle et al.
2020/0149222 A1 5/2020 Pang et al.
2020/0156861 A1 5/2020 Padilla
2020/0172294 A1 6/2020 Wittenberg et al.
2020/0189816 A1 6/2020 Zacherle
2020/0198865 A1 6/2020 Blehm et al.
2020/0216246 A1 7/2020 Ball et al.
2020/0232164 A1 7/2020 Parker et al.
2020/0247594 A1 8/2020 Billadeau et al.
2020/0262636 A1 8/2020 Wiemann et al.
2020/0277101 A1 9/2020 Holka et al.
2020/0277116 A1 9/2020 Blin
2020/0297132 A1 9/2020 Nguyen et al.
2020/0307852 A1 10/2020 Simpkins et al.
2020/0307853 A1 10/2020 Simpkins et al.
2020/0316898 A1 10/2020 Magnell
2020/0317383 A1 10/2020 Magnell et al.
2020/0317395 A1 10/2020 Bayona Salazar et al.
2020/0339330 A1 10/2020 Buscema et al.
2020/0346827 A1 11/2020 Shibuya
2020/0354894 A1 11/2020 Giuste et al.
2020/0369420 A1 11/2020 Bonnain et al.
2020/0385186 A1 12/2020 Shibuya
2020/0385187 A1 12/2020 Kirchhoff
2020/0391902 A1 12/2020 Valencia et al.
2020/0399002 A1 12/2020 Bonnain et al.
2021/0002010 A1 1/2021 Kooc et al.
2021/0002021 A1 1/2021 McLeod
2021/0024242 A1 1/2021 Cline
2021/0031966 A1 2/2021 Valencia
2021/0031968 A1 2/2021 Valencia
2021/0031973 A1 2/2021 Whitmore
2021/0070517 A1 3/2021 Harris et al.
2021/0078767 A1 3/2021 Simpkins et al.
2021/0079261 A1 3/2021 Jameson et al.
2021/0094740 A1 4/2021 Hayter et al.
2021/0100222 A1 4/2021 Hawkins et al.
2021/0112997 A1 4/2021 Walton et al.
2021/0114797 A1 4/2021 Padilla
2021/0139176 A1 5/2021 Bonnain
2021/0155363 A1 5/2021 Padilla
2021/0155364 A1 5/2021 Valencia et al.
2021/0155368 A1 5/2021 Binshtok et al.
2021/0155389 A1 5/2021 Gaidaeva et al.
2021/0164163 A1 6/2021 Staleman et al.
2021/0179314 A1 6/2021 Boukredine
2021/0180256 A1 6/2021 Bushhouse et al.
2021/0197513 A1 7/2021 Thierry
2021/0198021 A1 7/2021 Blin
2021/0221588 A1 7/2021 Zacherle et al.
2021/0222365 A1 7/2021 Giuste et al.
2021/0222370 A1 7/2021 Pang
2021/0229884 A1 7/2021 Peeler et al.
2021/0229886 A1 7/2021 Zacherle
2021/0254877 A1 8/2021 Massenzo et al.
2021/0261279 A1 8/2021 Zacherle et al.
2021/0261286 A1 8/2021 Couture et al.
2021/0276314 A1 9/2021 Pang et al.
2021/0284377 A1 9/2021 Couture et al.
2021/0284381 A1 9/2021 Valencia
2021/0284383 A1 9/2021 Cline
2021/0284384 A1 9/2021 Couture et al.
2021/0284413 A1 9/2021 Simmons et al.
2021/0284414 A1 9/2021 Rosenbrien
2022/0016691 A1* 1/2022 Scott ..... B21D 51/44
2022/0250807 A1* 8/2022 Barroso Machado ..... B65D 21/0217

FOREIGN PATENT DOCUMENTS

DE 60008982 3/2005
DE 402018101177-0009 12/2018
EM 004528040-0002 11/2017

(56) References Cited

FOREIGN PATENT DOCUMENTS

| | | |
|---|---|---|
| EP | 3487769 | 5/2019 |
| EP | 3554732 | 10/2019 |
| EP | 3288685 | 7/2020 |
| EP | 3302821 | 7/2020 |
| GB | 2537370 | 8/2019 |
| WO | WO 99/26855 | 6/1999 |
| WO | WO 2017/008961 | 1/2017 |
| WO | WO 2017/151667 | 9/2017 |
| WO | WO 2020/128415 | 6/2020 |

OTHER PUBLICATIONS

US 9,637,292 B2, 05/2017, Loftin et al. (withdrawn)

"Ellipsoid," Wikipedia, last updated May 9, 2019, 9 pages [retrieved online from: en.wikipedia.org/w/index.php?title=Ellipsoid&oldid=896349772].

"Inside a Ball Beverage Can Plant," Ball, Sep. 2002, 1 page [retrieved online from: www.ball.com/Ball/media/Ball/Global/Downloads/How_a_Ball_Metal_Beverage_Can_Is_Made.pdf?ext=.pdf].

"Rubber Cap," Milkampo, 2018, 2 pages [retrieved online Jan. 19, 2022 from: https://milkampo.com/producto/tapa-caucho/].

Ball Aluminum Cup "Making the Ball Aluminum Cup 'Make a Statement' Campaign (Behind the Scenes).", Youtube, Jun. 23, 2022, 2 pages [retrieved online Jul. 5, 2022 from www.youtube.com/watch?v=HwHAUc9_Wc].

Ball Aluminum Cup "Ball Aluminum Cup™, Now Appearing at Select Venuses," Youtube, Jan. 28, 2020, 2 pages [retrieved online Jul. 5, 2022 from: www.youtube.com/watch?v=YAIMAxLblgM].

Twilley "The Rise of the Plastic, Disposable Coffee Cup Lid," The Atlantic, May 9, 2011, 12 pages [retrieved online May 9, 2011 from: www.theatlantic.com/technology/archive/2011/05/the-rise-of-the-plastic-disposable-coffee-cup-lid/238573].

Villaluz "Geometry of Pringles: The Crunchy Hyperbolic Paraboloid," Interesting Engineering, Aug. 18, 2017, 11 pages [retrieved online from: https://interestingengineering.com/geometry-of- pringles-crunchy-hyperbolic-paraboloid].

International Search Report and Written Opinion for International (PCT) Patent Application No. PCT/US2022/018257, dated May 18, 2022 12 pages.

* cited by examiner

METAL CONTAINER AND END CLOSURE WITH SEAL

CROSS REFERENCE TO RELATED APPLICATIONS

This application claims priority from U.S. Provisional Patent Application Ser. No. 63/155,076, filed Mar. 1, 2021, entitled "Metal Container and End Closure with Seal"; the entire disclosure of which is hereby expressly incorporated by reference in its entirety.

FIELD OF THE INVENTION

Embodiments of the present invention generally relate to food and beverage packaging utilizing heat seal technology, and more specifically to domed metal food and beverage containers with end closures having seals or liners and snap-fit closure mechanisms.

BACKGROUND OF THE INVENTION

Containers, and more specifically food and beverage containers, are generally plastic, metal, or paper with an internal liner and food containers can also be cardboard. The plastic containers are difficult to recycle and, thus, lead to a lot of landfill waste. Cardboard containers can be weak and breakable food, e.g., chips or crisps, can be crushed or damaged in weak cardboard containers. Alternatively, cardboard containers are made with thick sidewalls and/or may have a foil lining and metal bottom portion. Paper containers are similar in that they are often thick and have an interior lining, which may be wax, plastic, or another material. The thick cardboard and foil attached thereto and lined paper containers can be difficult to recycle and can lead to a lot of landfill waste. Containers with thick cardboard and foil sides interconnected to a metal bottom are expensive and time consuming to manufacture because they involve many steps and different materials. These cardboard and metal containers and are also susceptible to water damage and failure. For example, food and beverage containers should be impermeable to prevent spoilage due to moisture and other contaminants. Cardboard and paper are not impermeable and, thus, a metal, wax, plastic or other lining must be used. However, if the lining is not properly sealed to the bottom and lid/closure, then leakage can occur, permitting moisture and other contaminants into the container.

Often times chips are sold in bags, but the chips can be crushed or damaged in bags. Additionally, the bags are over pressurized and underfilled in order to protect the chips from breaking. Additionally, bags are difficult to recycle and lead to landfill waste. Stackable chips are often sold in cylindrical containers that suffer from many of the disadvantages described above, in addition to flat bottoms that create pressure points for curved chips and increase chip breakage. Further, bags and soft cylindrical containers can make shipping more difficult if the contents are fragile, such as is the case with chips.

Metal beverage containers offer distributors and consumers many benefits. The metallic body of a beverage container provides optimal protection properties for products. For example, the metal body prevents $CO_2$ migration and transmission of UV radiation which may damage beverages, negatively influencing the flavor, appearance, or color of the product. Metal beverage containers also offer an impermeable barrier to light, water vapor, oils and fats, oxygen, and micro-organisms and keep the contents of the container fresh and protected from external influences, thereby guaranteeing a long shelf-life. The surfaces of metal containers are also ideal for decorating with brand names, logos, designs, product information, and/or other preferred indicia for identifying, marketing, and distinguishing the metallic container and its contents from other products and competitors. Thus, metal containers offer bottlers, distributors, and retailers an ability to stand out at the point of sale.

Beverage containers are generally formed of two separate pieces, a container body and a container end closure. The container body is formed from a single piece of metal and includes a bottom dome portion, a sidewall portion, and a neck portion with a decreased diameter extending upwardly from the sidewall portion. The neck portion is adapted to receive an end closure after the container body is filled with a beverage. An example of a known process of forming a container body is generally illustrated and described in "Inside a Ball Beverage Can Plant," available at: https://www.ball.com/getmedia/4db64513-133d-4fa8-9de0-89fd7c2724f9/How_a_Ball_Metal_Beverage_Can_Is_Made.pdf (last visited Mar. 28, 2017) which is incorporated herein by reference in its entirety. Metal beverage containers are typically cylindrical, although other shapes are known.

An important consideration in designing and fabricating such beverage containers involves providing a desirable balance between minimizing material requirements (such as providing relatively thin-gauge metal) while achieving a beverage container that will maintain its integrity and/or form, despite shipping and handling impacts or forces and impacts arising from dropped beverage containers and shipping mishaps. Moreover, it is critical to provide beverage containers which maintain integrity and/or form even when the contents are under pressure due to carbonated or otherwise gas-pressurized contents and/or arising from high internal temperatures, including, in some cases, pasteurization temperatures.

Additionally, metal food containers and especially metal beverage containers are often not re-closable. Meaning that after the consumer opens the metal food or beverage container, the container often cannot be reclosed to prevent spillage or leakage. Specifically, pressurized metal containers are often not reclosable, e.g., a typical soda or beer can.

SUMMARY OF THE INVENTION

These and other needs are addressed by the various embodiments and configurations of the present invention. This invention relates to a novel system, device, and methods for providing a metal food or beverage packaging utilizing heat seal technology that is re-closable and recyclable. The packaging can include a container and closure. In some embodiments, the food or beverage container and end closure are comprised of aluminum. In some embodiments, the food or beverage container is comprised of a metal material and the closure is comprised of a non-metal material. In additional embodiments, the aluminum container and/or closure also include a layer of heat seal material joined to the aluminum container and/or end closure. Note that the terms "lid," "closure," and "end closure" can be used interchangeably herein.

It is one aspect of various embodiments of the present invention to provide sealed food or beverage packaging that can be reclosed. In some embodiments, the connection point between the container and end closure of the packaging provides a package capable of being opened and closed, but not resealed. Thus, the closure can be reapplied to the container after opening. If the consumer wants to protect the product, save the contents for future consumption, or has a fidget factor, then the consumer can reconnect or rejoin the closure to the container to provide a splash or spill proof package.

Another aspect of various embodiments of the present invention is to provide a recyclable food or beverage package. Combining the container and closure after use can be a benefit for the recycling process because then the two parts (container and closure) are both recycled and are recycled together. A typical heat seal package uses two disposal points, for example, recycling for the container and landfill for the closure.

Another aspect of various embodiments of the present invention is to provide sealed food or beverage packaging that utilizes both heat seal technology and a typical aluminum end closure or an end closure with securing lugs. In some embodiments, the sealed packaging can retain a variety of internal pressures including pressures higher than possible with the heat seal alone. One advantage of the combined closure technology (heat seal and snap-on aluminum end closure with or without securing lugs) is that it allows the packaging to hold higher pressures compared to industry standard. In some embodiments, the end closure is manufactured using an aluminum shell along with a heat seal material that when joined together provide a superior experience and superior packaging capable of holding higher pressures.

In various embodiments, the container finish, i.e., the upper end opposite a closed bottom, is curled and connects easily with the end closure. The curled finish on the container will provide an enhanced customer experience once the package is open and the container finish is exposed. This container curl can be called a peripheral curl. The end closure can also have a curl that connects to the container finish. The closure curl can also be called a peripheral curl. In some embodiments, the end closure also has securing lugs to connect the end closure to the container finish. One purpose of the connection point using the container finish and closure design is to provide a packaging capable of holding a variety of pressures based on the product type, i.e., the packaging contents.

In some embodiments, the packaging includes a hinge or pry feature for easily releasing the closure from the container. Alternatively or additionally, the packaging closure includes securing lugs and/or prying lugs for easily releasing the closure from the container and reclosing the closure on to the container. In various embodiments, the closure is securely interconnected to the container via friction fit sidewalls or curls, i.e., the interaction between the closure sidewall/curl and the container sidewall/curl or using securing lugs or other dimple features. The securing lugs can be formed in the closure perimeter curl and snap outward to receive the container's curl and then snap back into place around the container's curl. The dimple features would function similarly and be positioned on a portion of the closure positioned below the container curl when the container and closure are interconnected. The dimple feature may be embossed, pressed, or otherwise formed in the closure.

In some embodiments, the container can be filled and the heat seal secured to the upper portion of the container and then the lid is attached to the upper portion of the container. In other embodiments, the heat seal is secured to the lid and then the lid is attached to the upper portion of the container.

In some embodiments, the liner or seal (which can be a pliable liner and/or pull ring) is comprised of PVC, polyester, acrylic, epoxy, LDPE, surlyn, wax, paper, and/or other plastic. In various embodiments, the seal or liner and/or pull ring are comprised of an aluminum material or other metal base material with a PVC, polyester, acrylic, epoxy, LDPE, surlyn, wax, paper, and/or other plastic film or coating. In some embodiments, the liner and/or pull ring are comprised solely of an aluminum alloy or other metal material.

To facilitate opening, the consumer pulls on the pull ring to remove the closure from the container such that the contents of the container can be accessed. In some embodiments, a pull ring makes it easier for the consumer to open the packaging. In some embodiments, after the consumer pulls on the pull ring and pulls the closure off of the container, the liner or seal remains attached to the closure. When the consumer wants to close the container, the consumer can push the closure onto the container finish and the seal will remain between the closure and container. Here, the closure with the liner can be recycled together if they are both comprised of the same or a similar material. If the liner is a different material than the closure or the liner has a coating that prevents recycling of the liner, then the closure and liner would have to be disposed into the trash and would be landfill bound. Thus, depending on the material of the liner, the liner and closure may be able to be recycled together.

In other embodiments, after the consumer pulls on the pull ring and pulls the closure off of the container, the consumer can also pull the liner or seal off of the closure. Therefore, when the consumer wants to close the container, the consumer can push the closure onto the container finish and the closure will snap directly onto the container. In this scenario, the container can be recycled, the closure can be recycled, and the liner can be recycled, depending on the material of the liner. For example, if all three are metallic materials, then they can be disposed of in the recycling and sorted at a recycling sorting facility. Also, if the liner is plastic, but is a recyclable plastic, then all three pieces (liner, closure, container) can be disposed of in a recycling bin and a recycling sorting facility can sort the materials to properly recycle each piece. Similarly, if the liner is attached directly to the container, then the user takes the closure off of the container and then pull the liner off of the container separately. Again, all three pieces may be recyclable or the liner may be trash depending on its material.

Embodiments of the present invention include a tamper resistant and/or tamper indicator feature. For example, when the consumer opens the container, he/she will be able to tell if the container is pressurized or if the container has been opened and not resealed such that it is no longer pressurized. In some embodiments, the lid further includes a tamper indicator, such as a button that will pop up or pop down (depending on whether the container is under vacuum or pressurized) after the container has been opened and the vacuum or pressure seal is broken.

Some embodiments of the present invention include a well similar to the nitrogen well described in U.S. patent application Ser. No. 16/942,574 filed on Jul. 29, 2020 and published as U.S. Patent Publication No. 2021/0031973, which is incorporated by reference herein. The nitrogen well is used to hold liquid nitrogen introduced into the well prior to sealing container. The well can surround a domed portion designed to increase the internal pressure the container can withstand or to hold a specific chip or other food shape. Alternatively, the bottom of the container has an annular support member that will contact a supporting surface to maintain the beverage container in a vertical position during stacking, consumer use, and the like, and that connects to the domed portion. The annular support member surrounds the domed portion designed to increase the pressure the container can withstand or to hold a specific chip or food shape. The bottom portion of the food or beverage container is generally formed to define a recessed or concave dome surface to resist deformation due to internal fluid pressures. The pressure at which the recessed surface is deformed or reversed is often called the "static dome reversal pressure" of the food or beverage container. The annular support member generally contains outer and inner surfaces that join the outer wall to the annular support member and that join the annular support member to the domed surface, respectively. These outer and inner surfaces have profiles which are shaped during the manufacture of the container to provide an outside dome profile and an inside dome profile. The configuration of the bottom portion of the food or beverage container is important for a variety of reasons. The outside dome profile is often configured for purposes of stacking food or beverage containers. The outside and inside dome profiles are also important in facilitating material usage reductions, since various geometric configurations can be utilized to enhance strength characteristics. For example, the bottom portion may be configured to enhance the static dome reversal pressure characteristics and to reduce the risk of damage caused when a filled food or beverage container is dropped onto a hard surface during shipping, storage, and use. This drop resistance may be described as the cumulative drop height at which the bottom portion is damaged sufficiently to preclude the food or beverage container from standing upright on a flat surface.

In one embodiment, a metallic container and reclosable lid is provided comprising: the metallic container comprising: a sidewall have an upper end and a lower end; a closed bottom end extending from the lower end of the sidewall; an open upper end opposite the closed bottom end; and a curl around a perimeter of the upper end; the metallic reclosable lid comprising: a substantially flat central panel with an upper surface and a bottom surface; a substantially vertical portion extending downwardly from a perimeter of the central panel; a curl extending outwardly from a lower end of the substantially vertical portion and extending around a circumference of the metallic reclosable lid; and a liner operably interconnected to the bottom surface of the substantially flat central panel, the liner having a securing bead and a pull ring, and wherein the securing bead engages the container curl to secure the metallic reclosable lid to the metallic container.

In some embodiments, the liner is pliable, the securing bead is pliable, and the pull ring is pliable. In some embodiments, the metallic container further comprises a domed portion in the closed bottom end. In some embodiments, the metallic container further comprises a well extending downwardly from the lower end of the sidewall, the well having an interior wall interconnected on an upper end to a perimeter of the domed portion.

In one embodiment, a food or beverage packaging is provided comprising: a container comprising: a sidewall have an upper end and a lower end; a closed bottom end interconnected to the lower end of the sidewall; an open upper end opposite the closed bottom; and a curl around a perimeter of the upper end; a closure comprising: a substantially flat central panel with an upper surface and a bottom surface; a substantially vertical portion extending downwardly from a perimeter of the central panel; a curl extending inwardly from a lower end of the substantially vertical portion; a pry lug formed in a portion of the closure curl and extending around a portion of a circumference of the closure, the pry lug extending outwardly a distance from the substantially vertical portion of the closure, wherein the outwardly extending portion terminates in a curved portion interconnected to an inwardly oriented portion forming a loop; a securing lug formed in a portion of the closure curl and extending around a portion of the circumference of the closure, the secure lug extending inwardly from the substantially vertical portion of the closure and forming a loop, wherein the loop of the securing lug engages the container curl; and a liner attached to the bottom surface of the substantially flat central panel.

In some embodiments, the liner is a foil liner. In some embodiments, the container further comprises a domed portion in the closed bottom end. In some embodiments, the container further comprises a well extending downwardly from the lower end of the sidewall, the well having an interior wall interconnected on an upper end to a perimeter of the domed portion.

In one embodiment, a metallic reclosable lid is provided comprising: a substantially flat central panel with an upper surface and a bottom surface; a substantially vertical portion extending downwardly from a perimeter of the central panel; a curl extending outwardly from a lower end of the substantially vertical portion and extending around a circumference of the metallic reclosable lid; and a liner attached to the bottom surface of the substantially flat central panel, the liner having a securing bead and a pull ring, and wherein the securing bead engages a peripheral curl of a container to secure the metallic reclosable lid to the container.

In one embodiment, a metallic container closure is provided comprising: a substantially flat central panel with an upper surface and a bottom surface; a substantially vertical portion extending downwardly from a perimeter of the central panel; a curl extending inwardly from a lower end of the substantially vertical portion; a pry lug formed in a portion of the closure curl and extending around a portion of a circumference of the metallic container closure, the pry lug extending outwardly a distance from the substantially vertical portion of the metallic container closure, wherein the outwardly extending portion terminates in a curved portion interconnected to an inwardly oriented portion forming a loop; a securing lug formed in a portion of the closure curl and extending around a portion of the circumference of the metallic container closure, the secure lug extending inwardly from the substantially vertical portion of the metallic container closure and forming a loop, wherein the loop of the securing lug engages a peripheral curl of a container; and a liner attached to the bottom surface of the substantially flat central panel.

In one embodiment, a metallic container and reclosable lid is provided comprising: the metallic container comprising: a sidewall have an upper end and a lower end; a closed bottom end extending from the lower end of the sidewall; an open upper end opposite the closed bottom end; and a curl around a perimeter of the upper end; the metallic reclosable lid comprising: a substantially flat central panel with an upper surface and a bottom surface; a substantially vertical portion extending downwardly from a perimeter of the central panel; a curl extending outwardly from a lower end of the substantially vertical portion and extending around a circumference of the metallic reclosable lid; and a liner operably interconnected to the bottom surface of the substantially flat central panel, the liner having a securing bead, and wherein the securing bead engages the container curl to secure the metallic reclosable lid to the metallic container.

In additional embodiments, the liner has a pull ring that extends from a portion of a perimeter of the liner and extends out beyond a perimeter of the closure, and/or the liner is pliable, the securing bead is pliable, and the pull ring is pliable. In some embodiments, the liner is pliable and the securing bead is pliable. In various embodiments, the metallic container further comprises a domed portion in the closed bottom end, and/or the metallic container further comprises a well extending downwardly from the lower end of the sidewall, the well having an interior wall interconnected on an upper end to a perimeter of the domed portion. In various embodiments, the metallic reclosable lid has a thickness that is larger than a thickness of the liner.

In one embodiment, a food or beverage packaging is provided comprising: a container comprising: a sidewall have an upper end and a lower end; a closed bottom end interconnected to the lower end of the sidewall; an open upper end opposite the closed bottom; and a curl around a perimeter of the upper end; a closure comprising: a substantially flat central panel with an upper surface and a bottom surface; a substantially vertical portion extending downwardly from a perimeter of the central panel; a curl extending inwardly from a lower end of the substantially vertical portion; and a securing lug formed in a portion of the closure curl and extending around a portion of a circumference of the closure, the secure lug extending inwardly from the substantially vertical portion of the closure and forming a loop, wherein the loop of the securing lug engages the container curl.

In additional embodiments, the closure further comprises a pry lug formed in a portion of the closure curl and extending around a portion of the circumference of the closure, the pry lug extending outwardly a distance from the substantially vertical portion of the closure, wherein the outwardly extending portion terminates in a curved portion interconnected to an inwardly oriented portion forming a loop, and/or the closure further comprises a liner attached to the bottom surface of the substantially flat central panel. In various embodiments, the closure further comprises a liner attached to the bottom surface of the substantially flat central panel, and/or the liner is a foil liner. In various embodiments, the container further comprises a domed portion in the closed bottom end. In additional embodiments, the container further comprises a well extending downwardly from the lower end of the sidewall, the well having an interior wall interconnected on an upper end to a perimeter of the domed portion.

In one embodiment, a metallic reclosable lid is provided comprising: a substantially flat central panel with an upper surface and a bottom surface; a substantially vertical portion extending downwardly from a perimeter of the central panel; a curl extending outwardly from a lower end of the substantially vertical portion and extending around a circumference of the metallic reclosable lid; and a liner attached to the bottom surface of the substantially flat central panel, the liner having a securing bead around at least a portion of a perimeter of the liner and a pull ring extending outwardly beyond a perimeter of the curl, and wherein the securing bead engages a peripheral curl of a container to secure the metallic reclosable lid to the container.

In additional embodiments, the liner is pliable, the securing bead is pliable, and the pull ring is pliable.

In one embodiment, a metallic container closure is provided comprising: a substantially flat central panel with an upper surface and a bottom surface; a substantially vertical portion extending downwardly from a perimeter of the central panel; a curl extending inwardly from a lower end of the substantially vertical portion; a pry lug formed in a portion of the closure curl and extending around a portion of a circumference of the metallic container closure, the pry lug extending outwardly a distance from the substantially vertical portion of the metallic container closure, a securing lug formed in a portion of the closure curl and extending around a portion of the circumference of the metallic container closure, wherein the loop of the securing lug engages a peripheral curl of a container; and a liner attached to the bottom surface of the substantially flat central panel.

In some embodiments, the outwardly extending portion of the pry lug terminates in a curved portion interconnected to an inwardly oriented portion forming a loop. In various embodiments, the secure lug extends inwardly from the substantially vertical portion of the metallic container closure and forms a loop.

In some embodiments of the method of making the closures, the process begins with a precoated coil that is fed into a stamping press to form a blank of any various shapes and sizes. In some embodiments, a partially uncoated coil is fed into the stamping press to for a blank. The blank is subsequently formed into an intermediate aluminum form called a cup. The cup is fed into a transfer press, which performs the following steps to the cup to form a closure: curl and lug formation. Securing lugs and/or pry lugs can then be formed in the closure curl.

In some embodiments, the foil liner and closure are both manufactured in two parallel paths that eventually connect during manufacturing process to create one product: a closure with the liner attached thereto. Thus, after the closure is formed, the liner is connected to the closure, which occurs before the container is filled. Then the closures (with liners) exit the transfer press and are stacked, bagged, and palletized.

In alternative embodiments, the closures (without liners) exit the transfer press and are stacked, bagged, and palletized. At a filler station, the container is filled with the food or beverage. Then the container is sealed, i.e., the foil liner is applied to the container. Lastly, the closure is applied/connected to the foil liner and container.

In various embodiments of the method of manufacturing the closure, the process begins with a precoated that is fed into a stamping press to for a blank. In some embodiments, a partially uncoated coil is fed into the stamping press to for a blank. The blank is then drawn into a near-finished version of the final closure product with a small flange around the circumference. The flange is then curled over to hide the cut edge from the consumer and/or to form a friction fit closure mechanism. The curl also adds rigidity and creates a surface to pull against when removing the closure from a container.

In some embodiments, the foil liner and closure are both manufactured in two parallel paths that eventually connect during manufacturing process to create one product: a closure with the liner attached thereto. Thus, after the closure is formed, the liner is connected to the closure, which occurs before the container is filled. Then the closures (with liners) exit the transfer press and are stacked, bagged, and palletized.

In alternative embodiments, the closures (without liners) exit the transfer press and are stacked, bagged, and palletized. At a filler station, the container is filled with the food or beverage. Then the container is sealed, i.e., the foil liner is applied to the container. Lastly, the closure is applied/connected to the foil liner and container.

In some embodiments, the method of making the closures can occur in a single forming machine, and in other embodiments the method of making the closures can occur in a series of forming machines. Moreover, a plurality of closures can be made in each action of a machine. In another embodiment of the present invention, a closure is provided that is manufactured with conventional manufacturing equipment.

For purposes of further disclosure, the following references generally related to domed containers with closure mechanisms or lids/closures with friction fit closure and/or securing mechanisms are hereby incorporated by reference in their entireties:

U.S. patent application Ser. No. 16/942,574 filed on Jul. 29, 2020 and published as U.S. Patent Publication No. 2021/0031973;

U.S. patent application Ser. No. 15/625,518 filed on Jun. 16, 2017 and published as U.S. Publication No. 2017/0361971; and U.S. patent application Ser. No. 17/376,010 filed on Jul. 14, 2021 and published as U.S. Publication No. 2022/0016691.

One method of improving the strength characteristics of beverage containers is known as "reforming." During reforming, the inside dome profile of the bottom portion of a beverage container is formed to create a geometric configuration with improved strength characteristics. Reforming results in increased buckle and drop strength for beverage containers. Methods and apparatus, known as "reformers," used in reforming the inside dome profile of beverage containers are disclosed in U.S. Pat. Nos. 5,105,973, 5,222,385, 5,355,709, 5,524,468, 5,540,352, 5,697,242, 5,704,241, 5,706,686, 5,934,127, 6,616,393, 6,837,089, and 6,959,577 which are each incorporated herein in their entirety.

The phrases "at least one," "one or more," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification and claims are to be understood as being modified in all instances by the term "about".

The term "a" or "an" entity, as used herein, refers to one or more of that entity. As such, the terms "a" (or "an"), "one or more," and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C. § 112(f). Accordingly, a claim incorporating the term "means" shall cover all structures, materials, or acts set forth herein, and all of the equivalents thereof. Further, the structures, materials, or acts and the equivalents thereof shall include all those described in the summary of the invention, brief description of the drawings, detailed description, abstract, and claims themselves.

These and other advantages will be apparent from the disclosure of the invention(s) contained herein. The above-described embodiments, objectives, and configurations are neither complete nor exhaustive. The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description and no limitation as to the scope of the present invention is intended by either the inclusion or non-inclusion of elements, components, etc. in this Summary of the Invention. Additional aspects of the present invention will become more readily apparent from the Detailed Description, particularly when taken together with the drawings.

Any one or more aspects described herein can be combined with any other one or more aspects described herein. Any one or more features described herein can be combined with any other one or more features described herein. Any one or more embodiments described herein can be combined with any other one or more embodiments described herein. Additionally, any feature described herein can be claimed in combination with any other feature(s) as described herein, regardless of whether the features come from the same described embodiment.

BRIEF DESCRIPTION OF THE DRAWINGS

Those of skill in the art will recognize that the following description is merely illustrative of the principles of the invention, which may be applied in various ways to provide many different alternative embodiments. This description is made for illustrating the general principles of the teachings of this invention and is not meant to limit the inventive concepts disclosed herein.

The accompanying drawings, which are incorporated in and constitute a part of the specification, illustrate embodiments of the invention and together with the general description of the invention given above and the detailed description of the drawings given below, serve to explain the principles of the invention.

Figure 1:
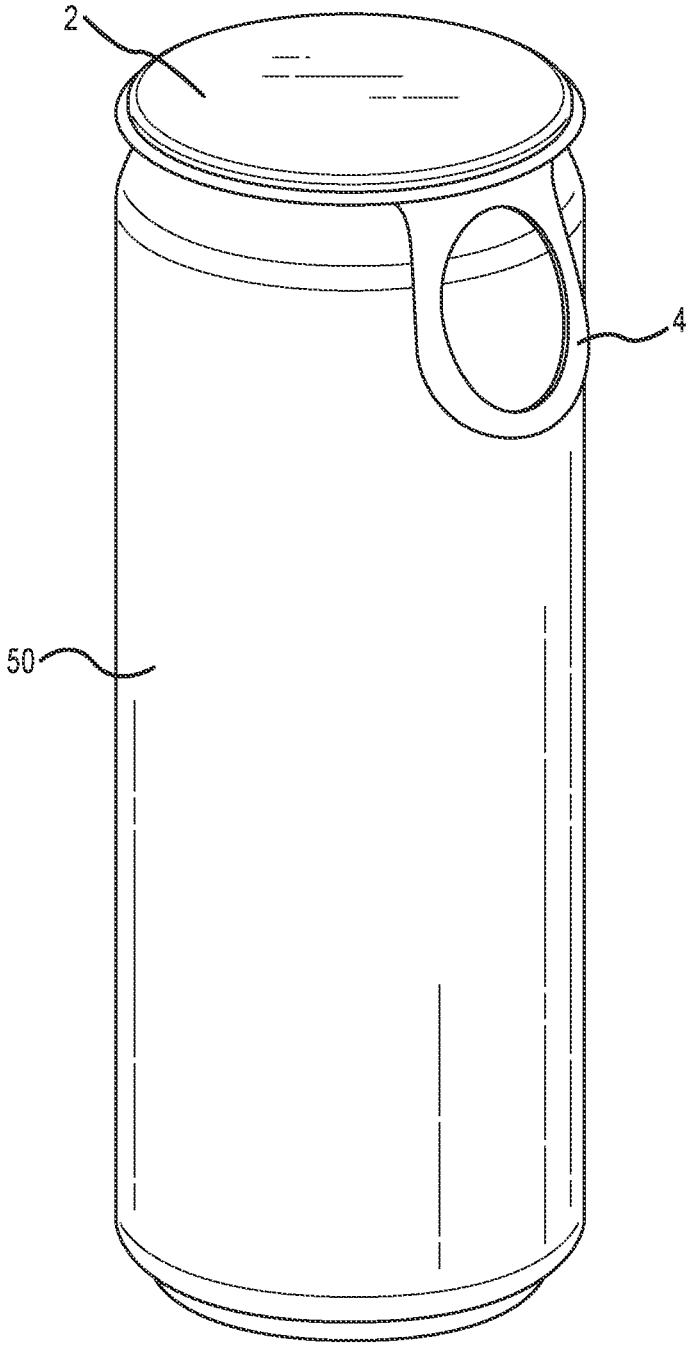
FIG. 1 is a perspective view of one embodiment of the food or beverage packaging.

To assist in the understanding of the embodiments of the present invention, the following list of components and associated numbering found in the drawings is provided herein:

2 Closure
4 Pull Ring of Liner/Seal
6 Lip or Curl of Closure
10 Liner/Seal
12 Secure Bead
20 Pry Lug
22 Securing Lug
24 Transitional Tapering Portion
30 Indentation
32 Curl or Loop of Pry Lug
34 Cut End
36 Bottom Portion of Pry Lug
50 Container
52 Container Body
54 Container Neck
56 Container Contents
58 Headspace
60 Container Dome
62 Container Well or Annular Support Member
64 Container Curl
66 Container Top/Open End
68 Container Bottom/Closed End
H Height of Packaging
FH Freeboard Height
BH Body Height
R1 Radius of Curvature of Closure Curl
R2 Radius of Curvature of Container Curl
W Distance (bead or liner/seal extends inward)
L Inward Distance of Pry Lug
L2 Outward Distance of Pry Lug It should be understood that the drawings are not necessarily to scale, and various dimensions may be altered. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Those of skill in the art will recognize that the following description is merely illustrative of the principles of the invention, which may be applied in various ways to provide many different alternative embodiments. This description is made for illustrating the general principles of the teachings of this invention and is not meant to limit the inventive concepts disclosed herein.

Although the following text sets forth a detailed description of numerous different embodiments, it should be understood that the legal scope of the description is defined by the words of the claims set forth at the end of this disclosure. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

FIG. 1 is a perspective view of one embodiment of the food or beverage packaging comprising a container 50 and a closure 2 covering the open end of the container 50. The packaging includes a liner or seal 10 (shown in other figures) between the container 50 and the closure 2. The liner or seal 10 is secured to the under surface of the closure 2 (shown in FIG. 8) and contacts the upper lip portion of the container 50 or the container finish. The seal/liner 10 can be formed and attached using heat seal technology. The seal or liner 10 can be pliable or a foil seal/liner. The liner or seal can be pliable in some embodiments and can include a pull ring 4, which may also be pliable. In some embodiments, the pliable liner 10 and/or pull ring 4 are comprised of PVC, polyester, acrylic, epoxy, LDPE, surlyn, wax, paper, and/or other plastic. In various embodiments, the pliable liner 10 and/or pull ring 4 are comprised of an aluminum material or other metal base material with a PVC, polyester, acrylic, epoxy, LDPE, surlyn, wax, paper, and/or other plastic film or coating. In some embodiments, the pliable liner 10 and/or pull ring 4 are comprised solely of an aluminum alloy or other metal material.

To facilitate opening, the consumer pulls on the pull ring 4 to remove the closure 2 from the container 50 such that the contents of the container can be accessed. The pull ring 4 makes it easier for the consumer to open the packaging. In some embodiments, after the consumer pulls on the pull ring 4 and pulls the closure 2 off of the container 50, the liner or seal 10 remains attached to the closure 2. When the consumer wants to close the container 50, the consumer can push the closure 2 onto the container finish (i.e., upper portion of the container, not visible in FIG. 1) and the seal 10 will remain between the closure 2 and container 50. Here, the closure 2 with the liner 10 can be recycled together if they are both comprised of the same or a similar material.

In other embodiments, after the consumer pulls on the pull ring 4 and pulls the closure 2 off of the container, the consumer can also pull the liner or seal 10 off of the closure 2. Therefore, when the consumer wants to close the container 50, the consumer can push the closure 2 onto the container finish (i.e., upper portion of the container, not visible in FIG. 1) and the closure 2 will snap directly onto the container 50. In this scenario, the container 50 can be recycled, the closure 2 can be recycled, and the liner 10 can be recycled, depending on the material of the liner 10.

The packaging is reclosable/closable, but not re-sealable, meaning the container 50 can be closed to prevent spillage, but the consumer cannot reseal the packaging. The terms "liner" and "seal" (nouns) can be used interchangeably herein. Reclosable and closable mean that the user can secure the lid onto the container to prevent liquid or food from spilling out. In some embodiments, the packaging can be reclosed such that it is liquid-tight, meaning drops of liquid will not leak out if properly closed. However, the packaging is not re-sealable, meaning that the pressure or vacuum seal cannot be reinstituted by the user after they open the packaging. Thus, the packaging is not gas-tight after it has been opened.

In various embodiments, the closure 2 is securely interconnected to the container 50 via friction fit sidewalls or curls, i.e., the interaction between the closure sidewall or curl and the container sidewall or curl.

In some embodiments, a molded liner/seal (with a specific shape) is used instead of a flat liner. The specific shape or mold of the liner/seal can be dimensioned in such a way to support and assist the connection between container and closure, and additionally it can help with the seal to achieve higher pressures in the container 50.

Figure 2:
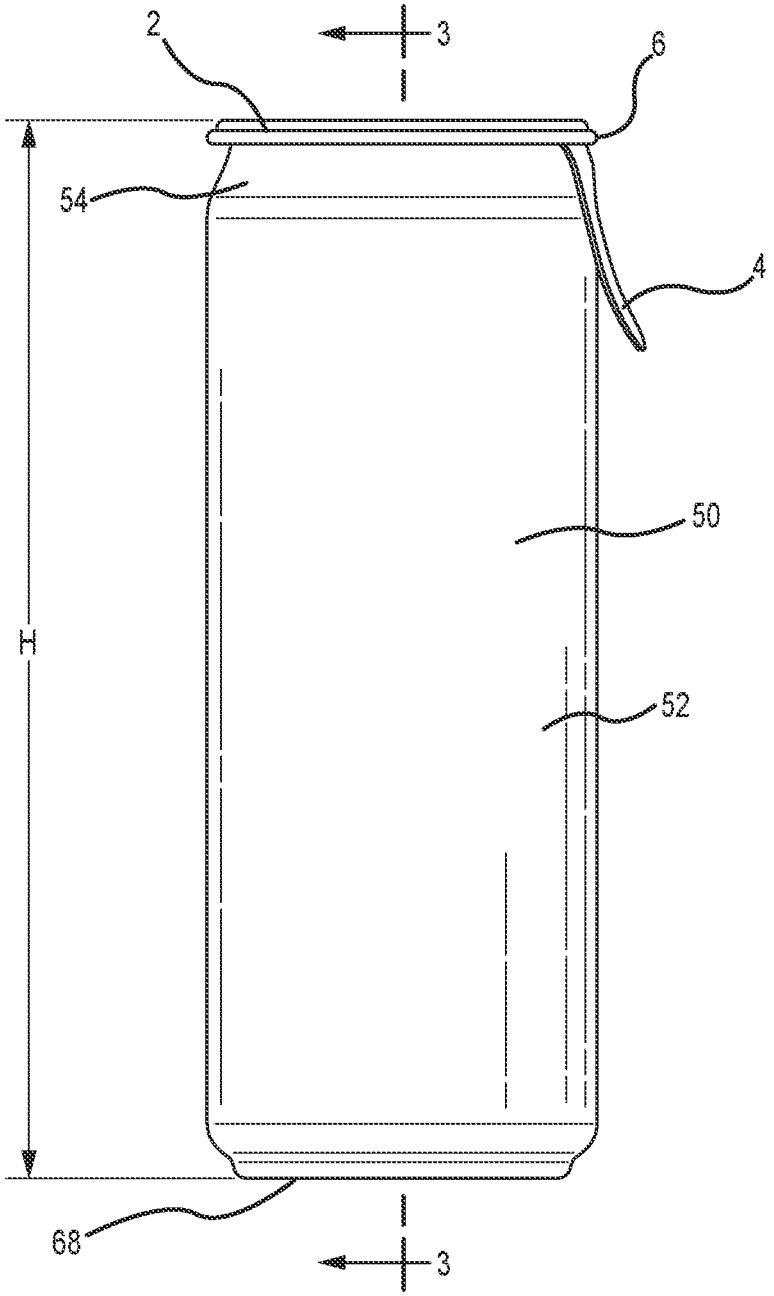
FIG. 2 is a front elevation view of the food or beverage packaging.

FIG. 2 is a front elevation view of the food or beverage packaging as shown in FIG. 1 comprising a container 50 and a closure 2 covering the open end of the container 50. The container 50 has an open top end opposite a closed bottom end 68 and a height H therebetween. The height H can be between about 5.0 inches and 6.5 inches in some embodiments, between about 5.5 inches and about 6.25 inches in a preferred embodiment, or about 6.124 inches in a more preferred embodiment. In some embodiments, the height H of the packaging is about 5.0 inches, 5.25 inches, 5.5 inches, 5.75 inches, 6.0 inches, 6.124 inches, 6.25 inches, or 6.5 inches, or any range there between. The container 50 has a container body 52 and a container neck 54. The closure 2 includes a liner 10 and a lip or curl 6 for interconnecting the closure 2 to the container 50.

Figure 3:
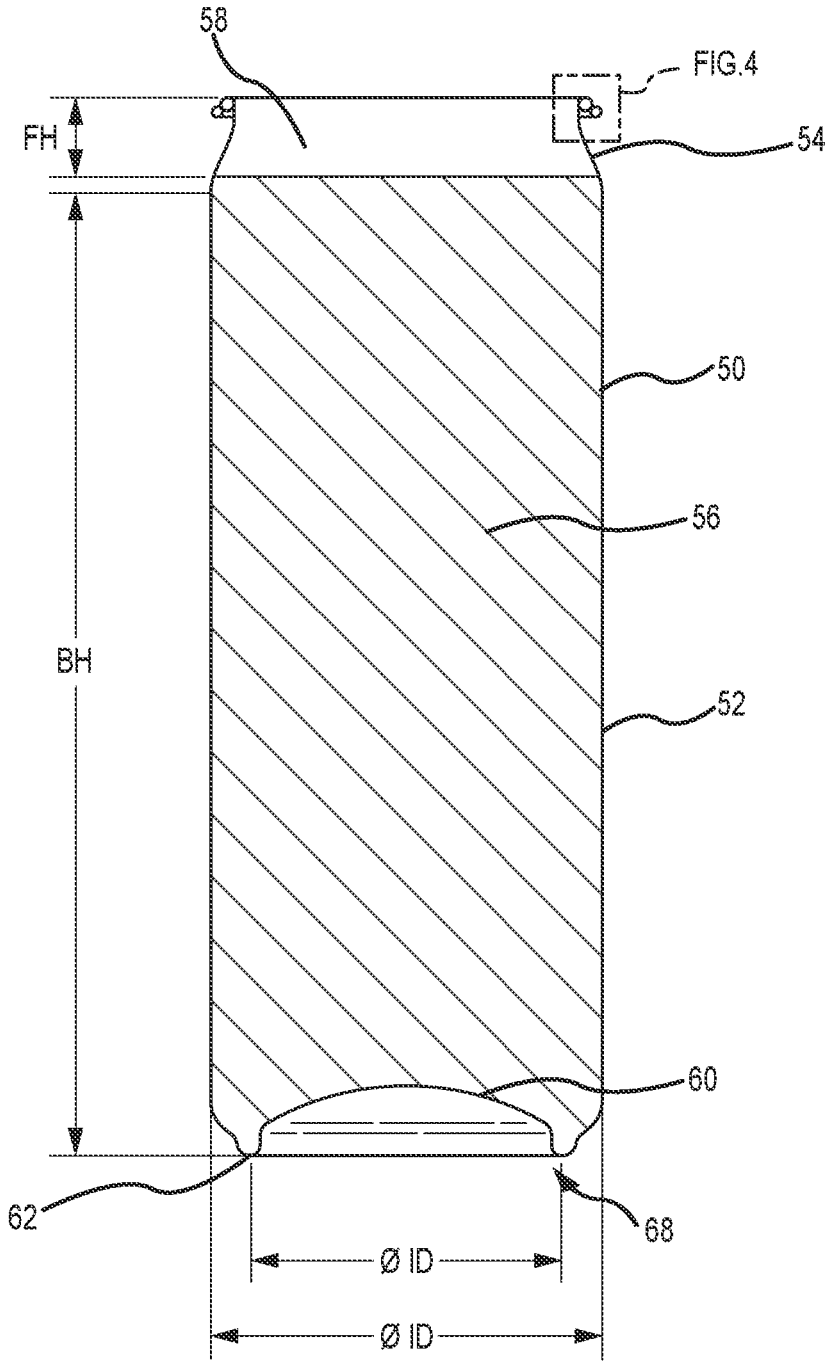
FIG. 3 is a cross-sectional view of the packaging taken along cut 3-3 of FIG. 2.

FIG. 3 is a cross-sectional view of the packaging taken along cut 3-3 of FIG. 2. The body 52 of the container 50 has a body height BH. The body height BH can be between about 4.5 inches and 6.5 inches in some embodiments, between about 5.0 inches and about 6.0 inches in a preferred embodiment, or about 5.561 inches in a more preferred embodiment. In some embodiments, the body height BH is about 4.5 inches, 4.75 inches, 5.0 inches, 5.25 inches, 5.5 inches, 5.561 inches, 5.75 inches, 6.0 inches, 6.25 inches, or 6.5 inches, or any range there between.

The contents 56 of the container can be filled past the body 52 and into the neck portion 54 of the container 50. The space above the container contents 56 is called the headspace 58 and has a freeboard height FB. The freeboard height FH can be between about 0.15 inches and 1.0 inch in some embodiments, between about 0.35 inches and about 0.55 inches in a preferred embodiment, or about 0.45 inches in a more preferred embodiment. In some embodiments, the freeboard height FH of the packaging is about 0.15 inches, 0.25 inches, 0.35 inches, 0.45 inches, 0.55 inches, 0.65 inches, 0.75 inches, 0.85 inches, 0.95 inches, or 1.0 inches, or any range there between.

In some embodiments, the bottom 68 of the container 50 includes a well 62, similar to the nitrogen well described in U.S. patent application Ser. No. 16/942,574 and published as U.S. Patent Publication No. 2021/0031973, which is incorporated herein by reference. Alternatively, the bottom 68 of the container 50 has an annular support member 62, which will contact a supporting surface to maintain the food or beverage container 50 in a vertical position during stacking, consumer use, and the like. The bottom portion 68 of the food or beverage container 50 is generally formed to define a recessed or concave dome surface 60 to resist deformation due to internal fluid pressures. The annular support member 62 generally contains outer and inner surfaces that join the outer wall to the annular support member 62 and that join the annular support member 62 to the domed surface 60, respectively. The container dome 60 can be shaped to hold chips, such as the dome described in U.S. patent application Ser. No. 16/942,574 and published as U.S. Patent Publication No. 2021/0031973, which is incorporated herein by reference, or the container dome 60 can be designed to resist deformation due to internal fluid pressures. The container body 52 has an outer diameter OD, and the annular support member 62 has an inner diameter ID measured from the center of the curved portion or curl. The outer diameter OD can be between about 1.5 inches and 3.0 inches in some embodiments, between about 2.0 inches and about 2.5 inches in a preferred embodiment, or about 2.259 inches in a more preferred embodiment. In some embodiments, the outer diameter OD is about 1.5 inches, 1.75 inches, 2.0 inches, 2.25 inches, 2.259 inches, 2.5 inches, 2.75 inches, or 3.0 inches, or any range there between. The inner diameter ID can be between about 1.0 inches and 2.5 inches in some embodiments, between about 1.5 inches and about 2.0 inches in a preferred embodiment, or about 1.789 inches in a more preferred embodiment. In some embodiments, the inner diameter ID is about 1.0 inches, 1.25 inches, 1.5 inches, 1.75 inches, 1.789 inches, 2.0 inches, 2.25 inches, or 2.5 inches, or any range there between. In some embodiments, a three-point bore micrometer is used.

Figure 4:
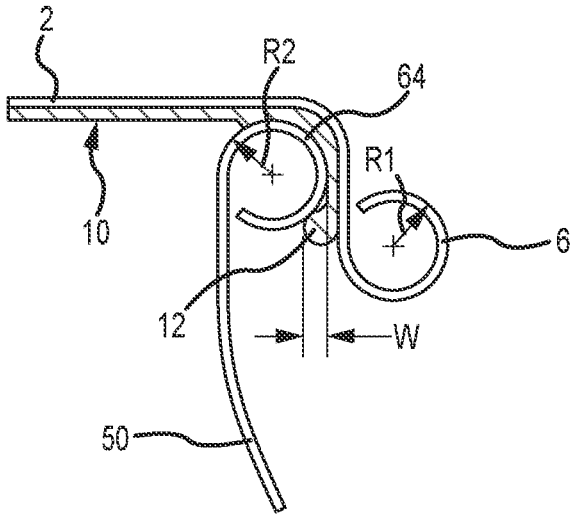
FIG. 4 is the detailed view of the portion identified in FIG. 3.

FIG. 4 is the detailed view of the portion identified in FIG. 3. This detail is also a cross section and shows the container 50 having a container curl 64 at the upper end (i.e., the container finish). The container curl 64 has a radius of curvature R2. The container curl 64 radius of curvature R2 can be between about 0.015 inches and 0.055 inches in some embodiments, between about 0.025 inches and about 0.045 inches in a preferred embodiment, or about 0.035 inches in a more preferred embodiment. In some embodiments, the container curl 64 radius of curvature R2 is about 0.015 inches, 0.02 inches, 0.025 inches, 0.03 inches, 0.035 inches, 0.04 inches, 0.045 inches, 0.05 inches, or 0.055 inches, or any range there between.

The closure 2 is positioned on the container 50 and the closure 2 has a closure curl 6 with a radius of curvature R1. The closure curl 6 radius of curvature R1 can be between about 0.015 inches and 0.055 inches in some embodiments, between about 0.025 inches and about 0.045 inches in a preferred embodiment, or about 0.035 inches in a more preferred embodiment. In some embodiments, the closure curl 6 radius of curvature R1 is about 0.015 inches, 0.02 inches, 0.025 inches, 0.03 inches, 0.035 inches, 0.04 inches, 0.045 inches, 0.05 inches, or 0.055 inches, or any range there between.

The packaging includes a liner 10, which is pliable in some embodiments, a foil seal 10 in other embodiments, and/or a heat seal 10 in still other embodiments, positioned between the closure 2 and the container 50. The liner/seal 10 extends along the underside of the closure 2 and down the vertical portion of the closure 2 such that it extends around the container curl 64. The liner/seal 10 can extend inward past the outer perimeter of the container curl 64 a distance W in order to securely hold the closure 2 on the container 50. The distance W can be between about 0.005 inches and 0.035 inches in some embodiments, between about 0.01 inches and about 0.02 inches in a preferred embodiment, or about 0.015 inches in a more preferred embodiment. In some embodiments, the distance W is about 0.005 inches, 0.01 inches, 0.015 inches, 0.02 inches, 0.025 inches, 0.03 inches, or 0.035 inches, or any range there between.

In some embodiments, the liner 10 includes a bead 12 along at least a portion of the perimeter of the liner 10. In some embodiments, the bead 12 extends around the entire perimeter of the liner 10. In other embodiments the bead 12 only extends around a portion of the perimeter of the liner 10. The bead 12 that helps secure the closure 2 to the container 50 because the bead 12 is the portion of the liner 10 that extends inwardly past the outer perimeter of the container curl 64 a distance W. The distance W can be between about 0.005 inches and 0.035 inches in some embodiments, between about 0.01 inches and about 0.02 inches in a preferred embodiment, or about 0.015 inches in a more preferred embodiment. In some embodiments, the distance W is about 0.005 inches, 0.01 inches, 0.015 inches, 0.02 inches, 0.025 inches, 0.03 inches, or 0.035 inches, or any range there between. Thus, the bead 12 can be called a securing bead or secure bead or a pliable secure bead. The bead 12 can be pliable in some embodiments. The liner 10 provides a seal to securely seal the closure 2 onto the container 50. Use of the liner 10 permits higher internal pressures in the packaging than possible without the liner 10.

As shown in FIG. 4, the securing bead 12 engages the container curl 64 and creates a biasing force pulling the closure 2 downward onto the container 50. The closure 2 also creates a biasing force pushing the seal/liner 10 and securing bead 12 inward to reduce the space between the container curl 64 and the vertical portion of the closure 2 and to increase the distance W. It is the combination of the closure 2 and seal/liner 10 that allows for higher internal pressures than are possible in current containers.

In some embodiments, the reclosable closure 2 has a thickness that is larger than a thickness of the liner/seal 10.

Figure 5:
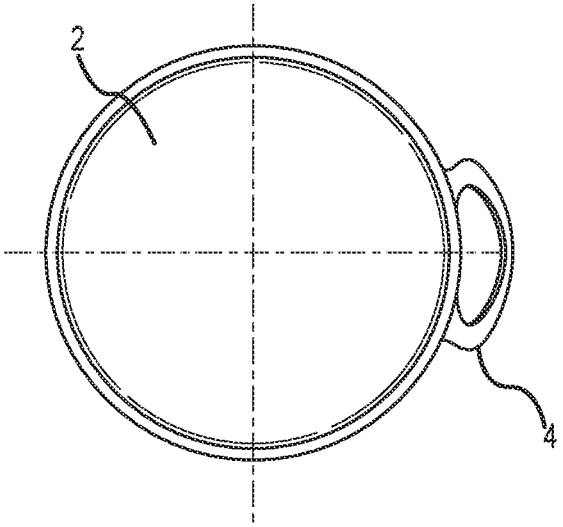
FIG. 5 is a top plan view of the food and beverage packaging.

FIG. 5 is a top plan view of the packaging shown in FIG. 1 with the closure 2 secured onto the container 50.

Figure 6:
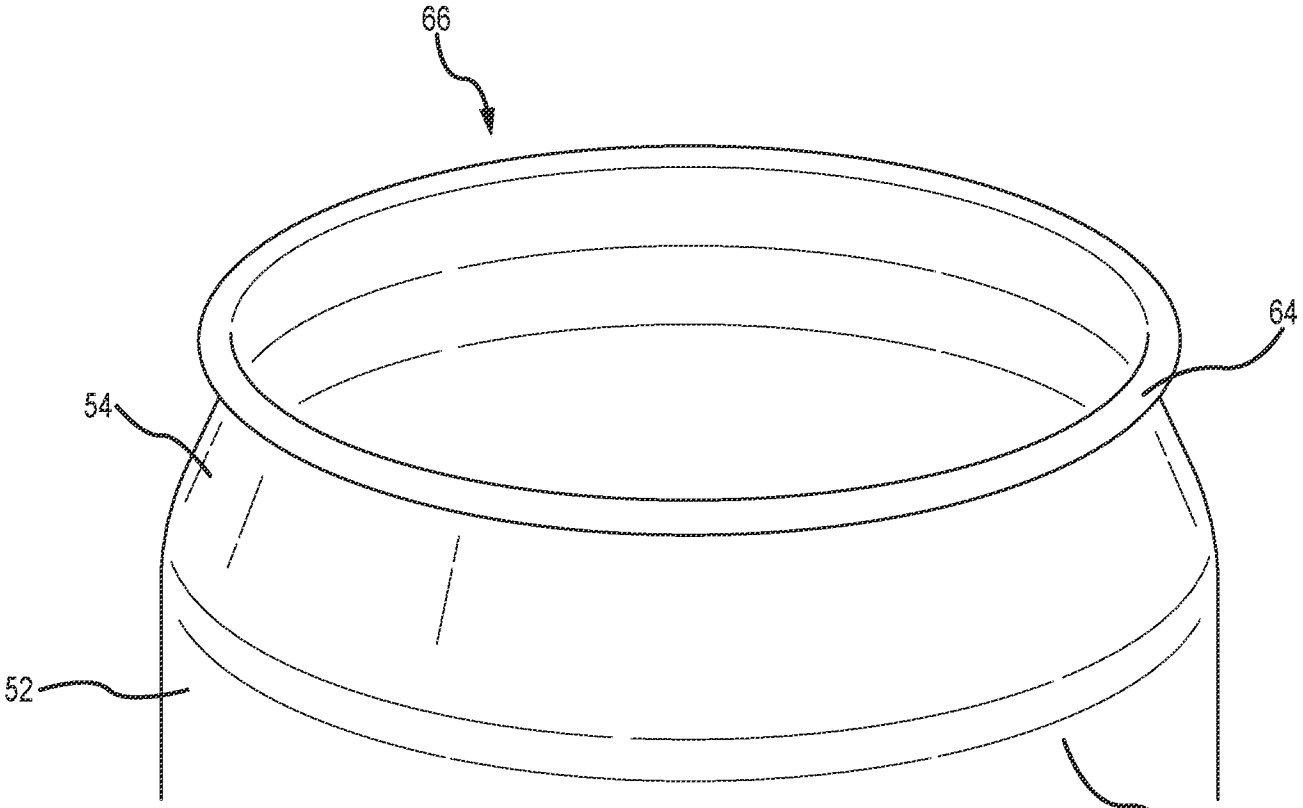
FIG. 6 is a perspective view of the top portion of the container.

FIG. 6 is a perspective view of the top portion 66 of the container 50, i.e., the top open end 66 of the container 50. The container finish (i.e., the upper portion of the container 50) includes a curl 64 connected to the neck 54 of the container 50. The neck 54 then connects to the body 52 of the container 50.

Figure 7:
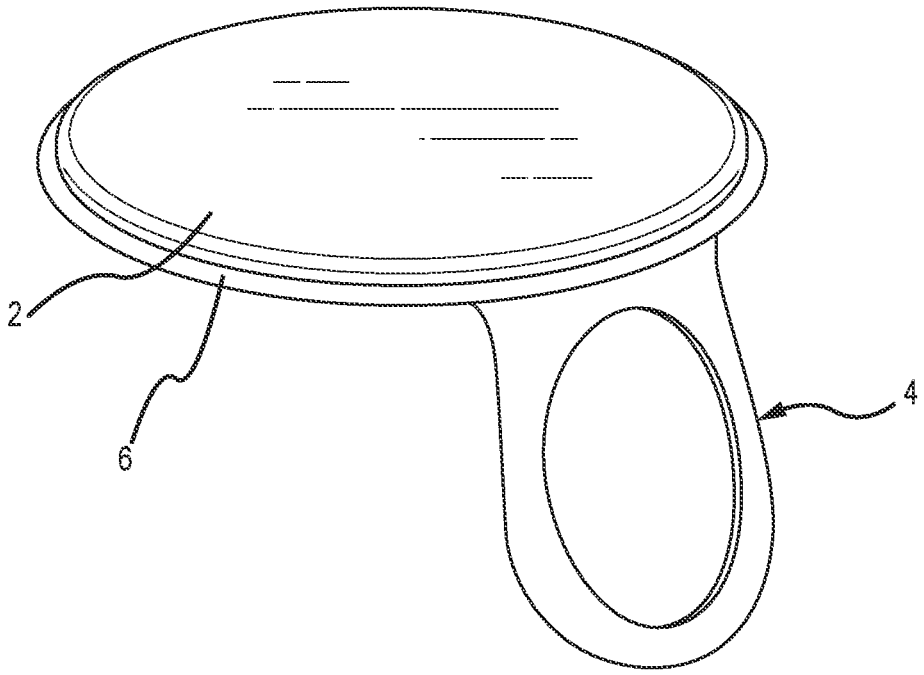
FIG. 7 is a top perspective view of the closure.

FIG. 7 is a top perspective view of the closure 2 showing the closure curl 6 and pull ring 4. The liner or seal 10 is not visible (other than the pull ring 4 connected thereto) in this view.

Figure 8:
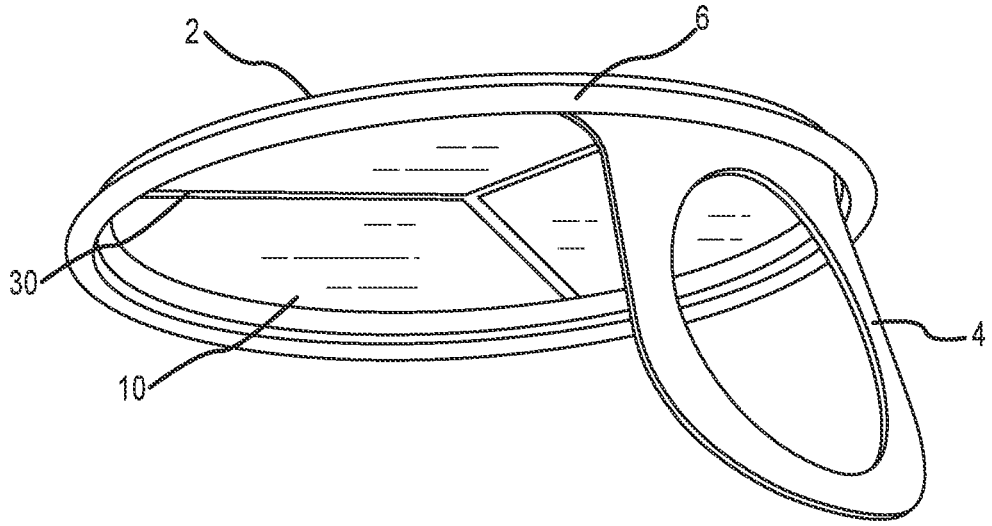
FIG. 8 is a bottom perspective view of the closure.

FIG. 8 is a bottom perspective view of the closure 2 showing the liner or seal 10 attached to the underside of the closure 2. The seal or liner 10 can be pliable or a foil seal/liner 10. The liner or seal 10 is connected to the pull ring 4, which can be pliable. Typically, if the liner or seal 10 is pliable, then the pull ring 4 is also pliable. However, the seal or liner 10 could be pliable and the pull ring 4 may not be pliable. The opposite is also possible: in some embodiments the seal or liner 10 is not pliable but the pull ring 4 is pliable. In some embodiments, the liner or seal 10 is the same material and one continuous piece with the pull ring 4. The liner or seal 10 can be one continuous smooth piece or it can have indentations 30, which add strength to the liner or seal 10. In some embodiments the liner/seal 10 is shaped to completely fill the underside of the closure 2 and extend down the perimeter (vertical portion in some embodiments) of the closure, but not extend below or beyond the closure curl 6 (see, e.g., FIG. 4). In other embodiments, the liner/seal 10 can extend down proximate the bottom of the closure curl 6.

Figure 9:
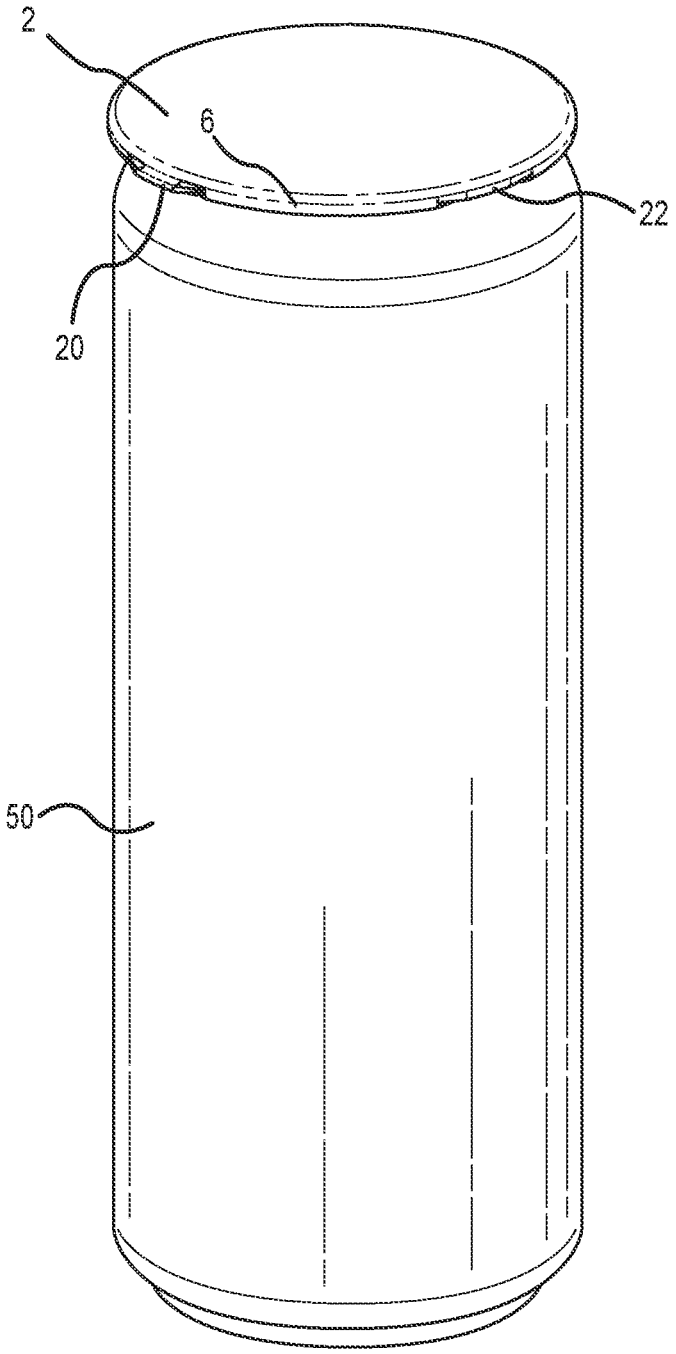
FIG. 9 is a perspective view of another embodiment of the food and beverage packaging.

FIG. 9 is a perspective view of another embodiment of the food and beverage packaging. The packaging includes a container 50 and a closure 2 with one or more pry lugs 20 and one or more securing lugs 22. The user removes the closure 2 from the container 50 by pulling upwardly on the pry lug 20. After the consumer opens the packaging and removes the closure 2, the packaging can be reclosed by the consumer pressing the closure 2 back onto the container 50, where the one or more securing lugs 22 hold the closure 2 onto the container 50. In some embodiments, the closure 2 includes a seal or liner (not shown in this figure, but shown in FIGS. 12-13, 15, 20-21) to more securely seal the closure 2 to the container 50 such that higher pressures in the container 50 can be achieved than possible without the seal or liner. Other embodiments do not include a seal or liner and typical pressures can be achieved in the container 50, i.e., standard pressures in the industry, which are lower pressures than can be achieved in embodiments with the liner or seal.

The packaging is closable, but not re-sealable, meaning the container 50 can be closed to prevent spillage, but the consumer cannot reseal the packaging. The seal or liner can be similar to the seal or liner 10 described in conjunction with FIGS. 1-8.

In various embodiments, the closure 2 is securely interconnected to the container 50 via friction fit sidewalls or curls, i.e., the interaction between the closure sidewall or curl 6 and the container sidewall or curl or using securing lugs 22 or other dimple features. The securing lugs 22 can be formed in the closure perimeter curl 6 and snap outward to receive the container's curl and then snap back into place around the container's curl. The dimple features function similarly and are positioned on a portion of the closure 2 positioned below the container curl 64 when the container 50 and closure 2 are interconnected. The dimple feature may be embossed, pressed, or formed in the closure 2.

Figure 10:
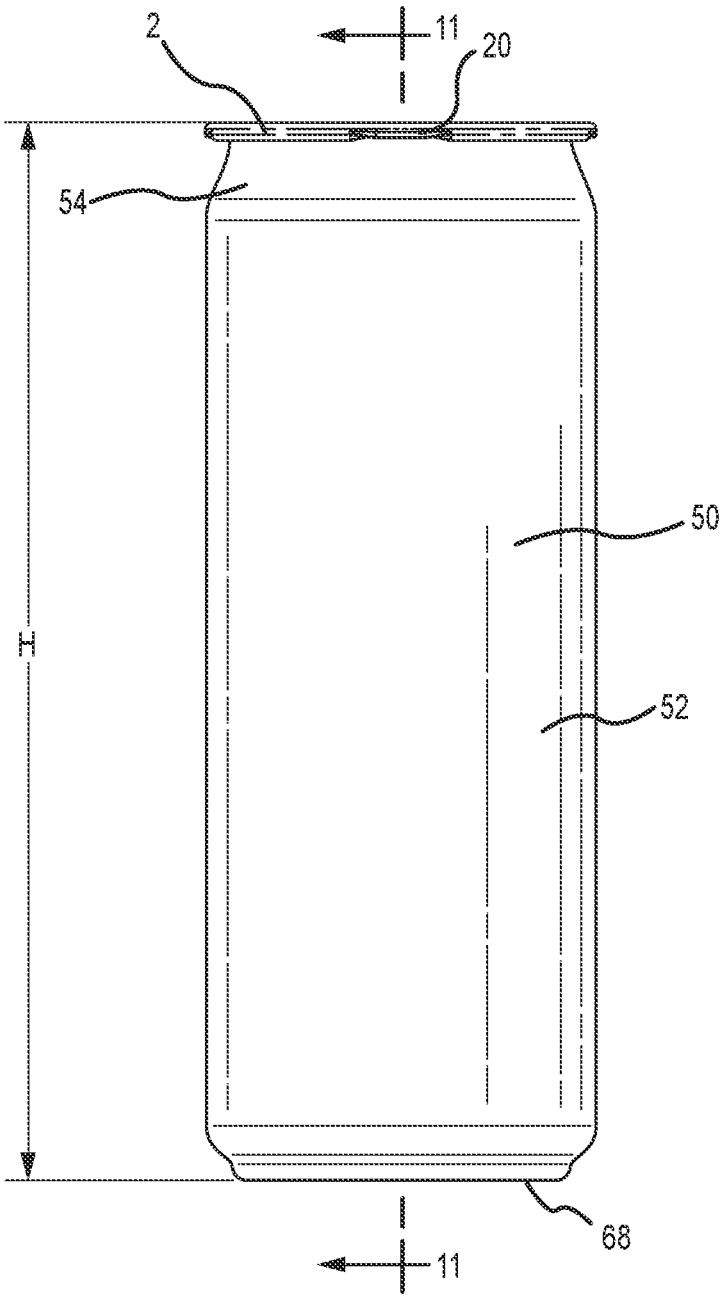
FIG. 10 is a front elevation view of the food or beverage packaging of FIG. 9.

FIG. 10 is a front elevation view of the food or beverage packaging comprising a container 50 and a closure 2 covering the open end of the container 50. The container 50 has an open top 66 end opposite a closed bottom end 68 and a height H therebetween. The height H from the container bottom end 68 to the top surface of the closure 2 is shown. The height H can be between about 5.0 inches and 6.5 inches in some embodiments, between about 5.5 inches and about 6.25 inches in a preferred embodiment, or about 6.115 inches in a more preferred embodiment. In some embodiments, the height H of the packaging is about 5.0 inches, 5.25 inches, 5.5 inches, 5.75 inches, 6.0 inches, 6.115 inches, 6.25 inches, or 6.5 inches, or any range there between. The container 50 has a container body 52 positioned between the bottom closed end and a container neck 54. The closure 2 includes at least one pry lug 20 on the perimeter of the closure 2 for removing the closure 2 from the container 50. The closure 2 can include a liner or seal 10 for creating a tight pressure seal. The seal or liner 10 can be pliable or a foil seal/liner 10. The closure 2 also includes one or more securing lugs 22 (shown in FIGS. 9, 11, 12, 14, 17, 19) and a curl (shown in FIG. 15) positioned around the perimeter of the container 50 for interconnecting the closure 2 to the container 50.

Figure 11:
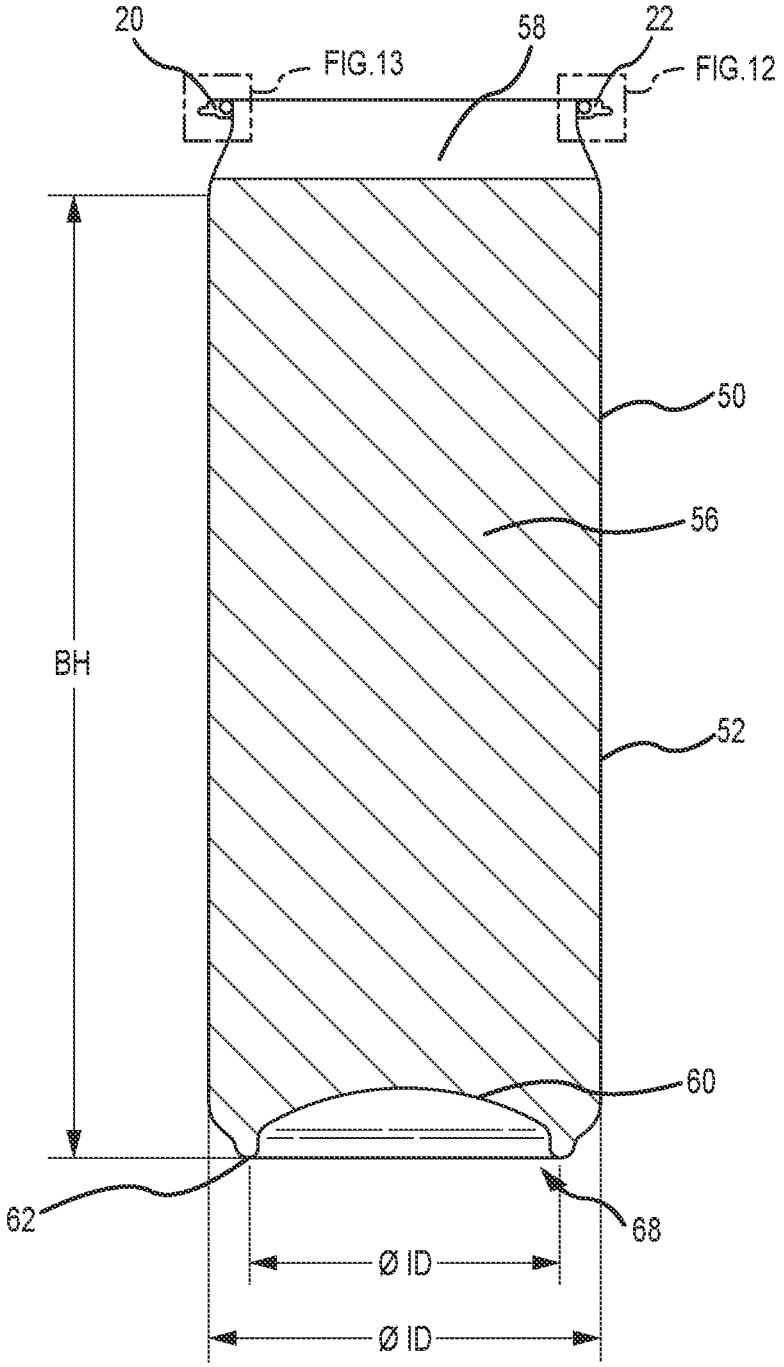
FIG. 11 is a cross-sectional view taken along cut 11-11 of FIG. 10.

FIG. 11 is a cross-sectional view taken along cut 11-11 of FIG. 10. The body 52 of the container 50 has a body height BH. The body height BH can be between about 4.5 inches and 6.5 inches in some embodiments, between about 5.0 inches and about 6.0 inches in a preferred embodiment, or about 5.572 inches in a more preferred embodiment. In some embodiments, the body height BH is about 4.5 inches, 4.75 inches, 5.0 inches, 5.25 inches, 5.5 inches, 5.572 inches, 5.75 inches, 6.0 inches, 6.25 inches, or 6.5 inches, or any range there between.

The contents 56 of the container can be filled past the body 52 and into the neck portion 54 of the container 50. The space above the container contents 56 is called the headspace 58. In some embodiments, the bottom 68 of the container 50 includes a well 62, similar to the nitrogen well described in U.S. patent application Ser. No. 16/942,574 and published as U.S. Patent Publication No. 2021/0031973, which is incorporated by reference herein. Alternatively, the bottom 68 of the container 50 has an annular support member 62 that will contact a supporting surface to maintain the food or beverage container 50 in a vertical position during stacking, consumer use, and the like. The bottom portion 68 of the food or beverage container 50 is generally formed to define a recessed or concave dome surface 60 to resist deformation due to internal fluid pressures. The annular support member 62 generally contains outer and inner surfaces that join the outer wall to the annular support member 62 and that join the annular support member 62 to the domed surface 60, respectively. The container dome 60 can be shaped to hold chips, such as the dome described in U.S. patent application Ser. No. 16/942,574 and published as U.S. Patent Publication No. 2021/0031973, which is incorporated by reference herein, or the container dome 60 can be designed to resist deformation due to internal fluid pressures. The container body 52 has an outer diameter OD, and the annular support member 62 has an inner diameter ID measured from the center of the curved portion or curl. The outer diameter OD can be between about 1.5 inches and 3.0 inches in some embodiments, between about 2.0 inches and about 2.5 inches in a preferred embodiment, or about 2.259 inches in a more preferred embodiment. In some embodiments, the outer diameter OD is about 1.5 inches, 1.75 inches, 2.0 inches, 2.25 inches, 2.259 inches, 2.5 inches, 2.75 inches, or 3.0 inches, or any range there between. The inner diameter ID can be between about 1.0 inches and 2.5 inches in some embodiments, between about 1.5 inches and about 2.0 inches in a preferred embodiment, or about 1.789 inches in a more preferred embodiment. In some embodiments, the inner diameter ID is about 1.0 inches, 1.25 inches, 1.5 inches, 1.75 inches, 1.789 inches, 2.0 inches, 2.25 inches, or 2.5 inches, or any range there between. In some embodiments, a three-point bore micrometer is used.

Figure 12:
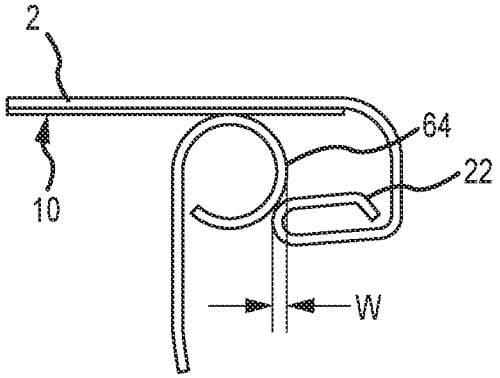
FIG. 12 is a detailed view of a portion of FIG. 11.

A pry lug 20 is shown on one side of the top of the container 50 and a securing lug 22 is shown on the other side of the top of the container 50. FIG. 12 is a detailed view of a portion of FIG. 11 and is a cross-sectional view showing a securing lug 22 or a secure point of the closure 2. The securing lug features 22 (also called snap-on features) aid in securing the closure 2 to the container 50. Specifically, the one or more securing lugs 22 snap onto and engage the curl 64 of the closure 2. It is the inward extending portion of the one or more securing lugs 22 that engages a lower portion of the container's curl 64 to hold the closure 2 onto the container 50. The closure 2 has a substantially flat upper surface that curves downward into a substantially vertical portion, which then curves inward and around forming a loop or curl to form the securing lug 22. The securing lug 22 can have an oval shape (shown) or a rectangle with rounded corners or be more rounded or circular in other embodiments. The radius of curvature of the securing lug 22 is smaller than the radius of curvature of the container curl 64. The securing lug 22 extends inwardly and touches or snaps around the container curl 64. The securing lug 22 extends inwardly past the outer perimeter of the container curl 64 a distance W. The distance W can be between about 0.005 inches and 0.02 inches in some embodiments, between about 0.007 inches and about 0.015 inches in a preferred embodiment, or about 0.01 inches in a more preferred embodiment. In some embodiments, the distance W is about 0.005 inches, 0.007 inches, 0.01 inches, 0.012 inches, 0.015 inches, 0.017 inches, or 0.02 inches, or any range there between. The securing lugs 22 can be formed in the closure perimeter curl 6 and snap outward to receive the container's curl 64 and then snap back into place around the container's curl 64 to hold the closure 2 onto the container 50. The securing lugs 22 can function similar to the lug features described in U.S. patent application Ser. No. 17/376,010 filed on Jul. 14, 2021 and published as U.S. Publication No. 2022/0016691, which is incorporated herein by reference. The closure 2 has a seal/liner 10 secured to the underside of the closure 2. The seal/liner 10 is positioned between the closure 2 and the top of the container curl 64 to form a tight seal. The seal/liner 10 can be formed and attached using heat seal technology. The seal or liner 10 can be pliable or a foil seal/liner 10. In some embodiments, the reclosable closure 2 has a thickness that is larger than a thickness of the liner/seal 10.

Figure 13:
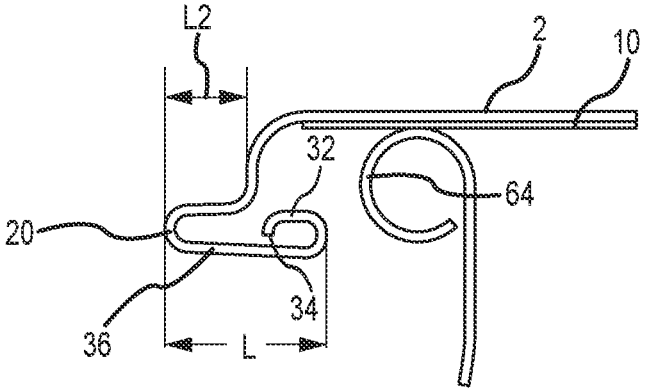
FIG. 13 is a detailed view of a portion of FIG. 11.

FIG. 13 is a detailed view of a portion of FIG. 11 and is a cross-sectional view showing a pry lug 20 or the pry point of the closure 2. Here, the perimeter of the closure 2 extends outwardly a distance L2 from the substantially vertical portion before it curves inwardly toward the container 50 and the cut end 34 curves back over to hide the cut end 34 and form a curl or loop 32. The pry lug 20 has an oval shape with a substantially linear bottom portion 36, but the pry lug 20 can be more rounded in other embodiments. The inwardly oriented bottom portion 36 has a length L. The outward distance L2 can be between about 0.01 inches and 0.1 inches in some embodiments, between about 0.03 inches and about 0.07 inches in a preferred embodiment, or about 0.05 inches in a more preferred embodiment. In some embodiments, the outward distance L2 is about 0.01 inches, 0.03 inches, 0.05 inches, 0.07 inches, 0.09 inches, or 0.1 inches, or any range there between. The inward distance L can be between about 0.05 inches and 0.2 inches in some embodiments, between about 0.08 inches and about 0.12 inches in a preferred embodiment, or about 0.1 inches in a more preferred embodiment. In some embodiments, the inward distance L is about 0.05 inches, 0.07 inches, 0.08 inches, 0.1 inches, 0.12 inches, 0.15 inches, 0.17 inches, or 0.2 inches, or any range there between.

The pry lug 20 does not engage the container curl 64. The user pulls upwardly on the pry lug 20 to remove the closure 2 from the container 50. The closure 2 has a seal/liner 10 secured to the underside of the closure 2. In some embodiments, the seal/liner 10 covers the substantially flat portion of the closure 2 and does not extend down the vertical portion or curl (not shown in this figure) of the closure 2. The seal/liner 10 is positioned between the closure 2 and the top of the container curl 64 to form a tight seal. The seal/liner 10 can be formed and attached using heat seal technology. The seal or liner 10 can be pliable or a foil seal/liner 10.

Figure 14:
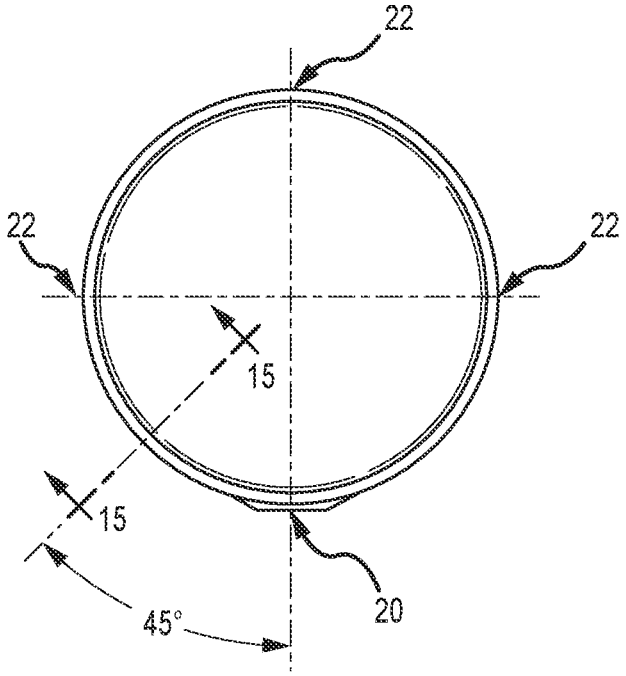
FIG. 14 is a top plan view of the closure.

FIG. 14 is a top plan view of the closure 2 showing the three secure points (i.e., securing lugs 22) and one pry point (i.e., the pry lug 20). The closure 2 can have one securing lug 22 in some embodiments or two securing lugs 22 in other embodiments. In a preferred embodiment, the closure 2 comprises three securing lugs 22. The closure 2 shown comprises three securing lugs 22. More than three securing lugs 22 are possible in other embodiments. The closure 2 can have one pry lug 20 in some embodiments or more than one pry lug 20 in other embodiments. In a preferred embodiment, the closure 2 comprises one pry lug 20. Additionally, the securing lugs 22 and/or pry lugs 20 can be longer or shorter (arc length) than shown in the drawings.

Figure 15:
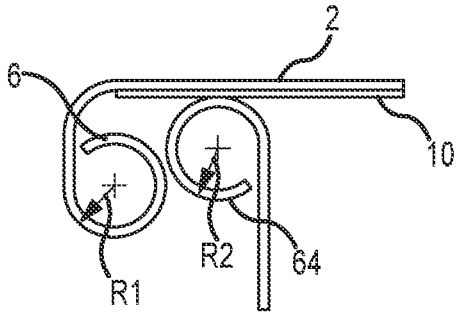
FIG. 15 is a cross-sectional view of a portion of the closure and container taken along line 15-15 in FIG. 14.

FIG. 15 is a cross-sectional view of a portion of the closure 2 and container 50 taken along line 15-15 in FIG. 14. This view shows the perimeter of the container 50 in locations other than at a securing lug 22 or a pry lug 20. Here, the closure 2 has a inboard curl 6 around the perimeter that extends inwardly from the substantially vertical portion of the closure 2. The closure curl 6 has a radius of curvature R1 that is similar to the radius of curvature R2 of the container curl 64. The container curl 64 radius of curvature R2 can be between about 0.015 inches and 0.055 inches in some embodiments, between about 0.025 inches and about 0.045 inches in a preferred embodiment, or about 0.035 inches in a more preferred embodiment. In some embodiments, the container curl 64 radius of curvature R2 is about 0.015 inches, 0.02 inches, 0.025 inches, 0.03 inches, 0.035 inches, 0.04 inches, 0.045 inches, 0.05 inches, or 0.055 inches, or any range there between. The closure curl 6 radius of curvature R1 can be between about 0.015 inches and 0.055 inches in some embodiments, between about 0.025 inches and about 0.045 inches in a preferred embodiment, or about 0.035 inches in a more preferred embodiment. In some embodiments, the closure curl 6 radius of curvature R1 is about 0.015 inches, 0.02 inches, 0.025 inches, 0.03 inches, 0.035 inches, 0.04 inches, 0.045 inches, 0.05 inches, or 0.055 inches, or any range there between.

However, in other embodiments the closure curl 6 can have a larger or smaller radius of curvature R1, which can be larger or smaller than the radius of curvature R2 of the container curl 64. In some embodiments, the closure curl 6 does not engage the container curl 64. Rather, it is the securing lugs 22 that engage the container curl 64. However, in other embodiments, the closure 2 is securely interconnected to the container 50 via friction fit curls, i.e., the interaction between the closure curl 6 and the container curl 64. The closure 2 has a seal/liner 10 secured to the underside of the closure 2. The seal/liner 10 is positioned between the closure 2 and the top of the container curl 64 to form a tight seal. The seal/liner 10 can extend between the closure curl and container curl 64 in some embodiments. The seal/liner 10 can be formed and attached using heat seal technology. The seal or liner 10 can be pliable or a foil seal/liner 10. In some embodiments, the seal/liner 10 covers the substantially flat portion of the underside of the closure 2 and does not extend down the vertical portion or curl 6 of the closure 2. In other embodiments, the seal or liner 10 extends downward such that it is positioned between the container curl 64 and closure curl 6.

Figure 16:
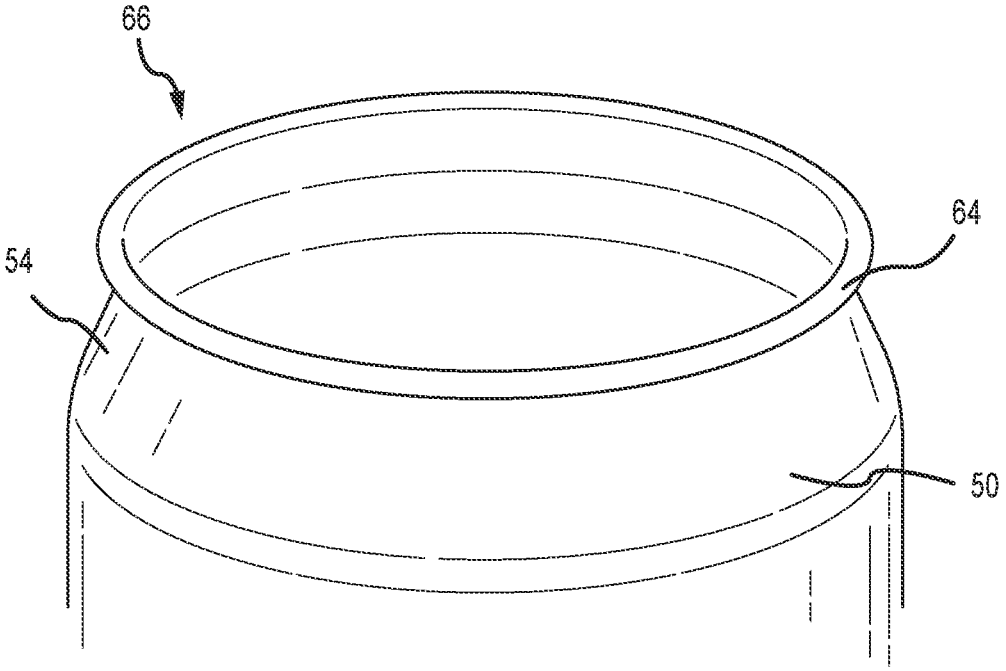
FIG. 16 is a perspective view of the top portion of the container.

FIG. 16 is a perspective view of the top portion 66 of the container 50, i.e., the top open end 66 of the container 50. The container finish (i.e., the upper portion of the container 50) includes a curl 64 connected to the neck 54 of the container 50. The neck 54 then connects to the body 52 of the container 50.

Figure 17:
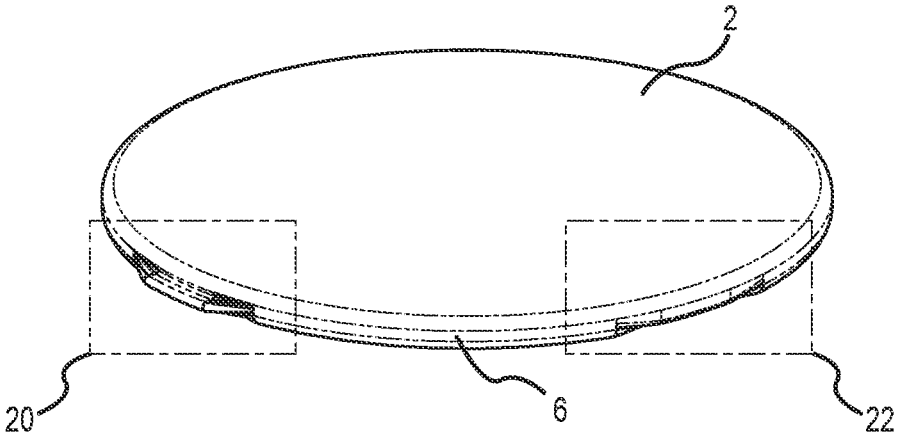
FIG. 17 is a top perspective view of the closure showing closure curl, pry lug, and secure lug.

FIG. 17 is a top perspective view of the closure 2 showing closure curl 6, pry lug 20, and secure lug 22. The liner or seal is not visible in this view.

Figure 18:
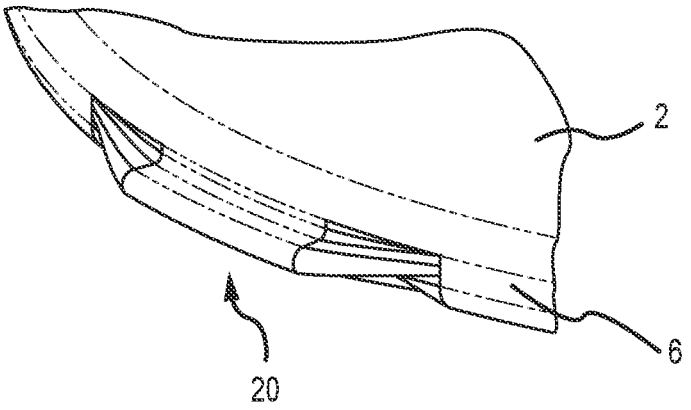
FIG. 18 an enlarged top perspective view of the exterior portion of the pry lug in the closure and closure curl.

FIG. 18 an enlarged top perspective view of the exterior portion of the pry lug 20 in the closure 2 and closure curl 6. The pry lug 20 is formed by pinching or clamping the curl 6 in such a way that a new shape is created in the curl 6. The pinching or clamping of the curl 6 pushes the metal outboard (away from the container 50 and closure center axis) to form a pry lug 20 that extends outwardly from the curl 6. The pry lug 20 extends outwardly beyond the perimeter of the closure 2 such that it forms a tab or protrusion that the consumer can engage and pull upwardly to remove the closure 2 from the container 50.

Figure 19:
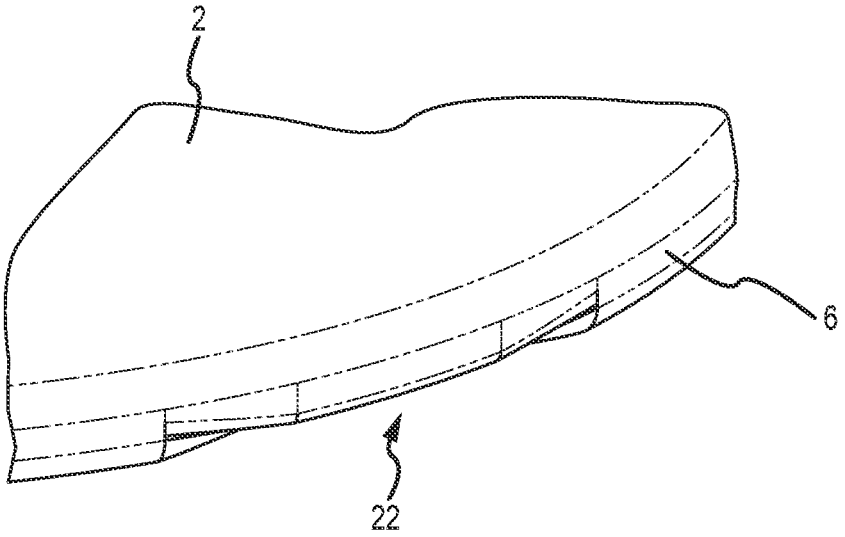
FIG. 19 is an enlarged top perspective view of the exterior portion of a securing lug in the closure.

FIG. 19 is an enlarged top perspective view of the exterior portion of a securing lug 22 in the closure 2. The securing lug 22 is formed by pinching or clamping the closure curl 6 in such a way that a new shape is formed in the curl 6. The pinching or clamping squats the metal and controls the inner diameter of the closure curl 6 such that the securing lug 22 has an interference fit with the container's curl 64 to secure the closure 2 to the container 50. The securing lug 22 does not extend outwardly beyond the perimeter of the closure 2. Rather, the securing lug 22 is flush with the outer perimeter of the closure 2 and extends inwardly from the outer perimeter such that it can securely engage the container finish. The securing lug 22 extends inwardly toward the container 50 more than the closure curl 6. Compare FIG. 12 to FIG. 15.

Figure 20:
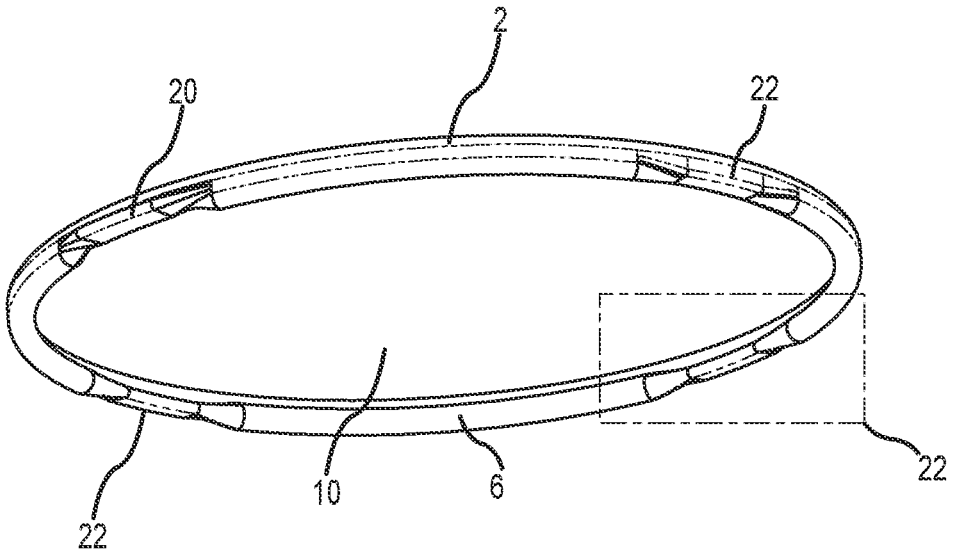
FIG. 20 is a bottom perspective view of the closure.

FIG. 20 is a bottom perspective view of the closure 2 showing the liner/seal 10 on the underside surface of the closure 2. The closure 2 shown has three securing lugs 22 and one pry lug 20. However, the closure 2 can have one securing lug 22 or two securing lugs 22 in other embodiments. More than three securing lugs 22 are also possible in other embodiments. The closure 2 can have more than one pry lug 20 in other embodiments. Additionally, the lugs 20, 22 can be longer or shorter (arc length) than shown in the drawings. The seal or liner 10 can be pliable or a foil seal/liner 10. The seal or liner 10 may be formed and attached using heat seal technology.

Figure 21:
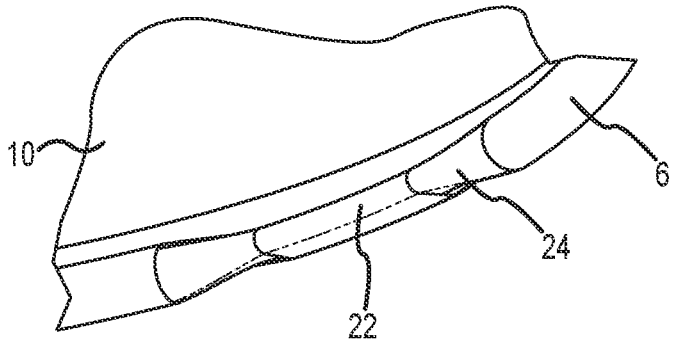
FIG. 21 is an enlarged view of the interior portion of the securing lug.

FIG. 21 is an enlarged view of the interior portion of the securing lug 22. As seen in FIGS. 20 and 21, the securing lugs 22 are formed by a transitional tapering portion 24 that connects to the securing lug 22. The securing lug 22 has a constant radius of curvature, which is smaller than the closure curl 6 radius of curvature, i.e., the portion shown in FIG. 15.

In various embodiments, the closures and the containers are comprised of aluminum or an aluminum alloy, and preferably comprised of recyclable aluminum or a recyclable aluminum alloy. In some embodiments, the closure and container are the same material and can even be the same type of aluminum alloy. The closure and/or container can be comprised of other materials, including other metals, and remain within the scope of this disclosure.

Additionally, various features/components of one embodiment may be combined with features/components of another embodiment. For example, features/components of one figure can be combined with features/components of another figure or features/components of multiple figures. To avoid repetition, every different combination of features has not been described herein, but the different combinations are within the scope of this disclosure. Additionally, if details (including angles, dimensions, etc.) about a feature or component are described with one embodiment or one figure, then those details can apply to similar features of components in other embodiments or other figures.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims. Further, the invention(s) described herein is capable of other embodiments and of being practiced or of being carried out in various ways. It is to be understood that the phraseology and terminology used herein is for the purpose of description and should not be regarded as limiting.

Any one or more aspects described herein can be combined with any other one or more aspects described herein. Any one or more features described herein can be combined with any other one or more features described herein. Any one or more aspects or features described in connection with one embodiment can be combined with or included with any other embodiment described herein. Any one or more embodiments described herein can be combined with any other one or more embodiments described herein. Additionally, any feature described herein can be claimed in combination with any other feature(s) as described herein, regardless of whether the features come from the same described embodiment.

What is claimed is:

1. A food or beverage packaging comprising:

a container comprising:

a sidewall having an upper end and a lower end;

a closed bottom end interconnected to the lower end of the sidewall;

an opening at the upper end opposite the closed bottom end; and a container curl around a perimeter of the upper end;

a metallic closure comprising:

a substantially flat central panel with an upper surface and a bottom surface;

a substantially vertical portion extending downwardly from a perimeter of the central panel;

a closure curl extending inwardly from a lower end of the substantially vertical portion;

a securing lug formed in a portion of the closure curl and extending around a portion of a circumference of the metallic closure, the securing lug extending inwardly from the substantially vertical portion of the metallic closure and forming a loop, wherein the loop of the securing lug engages the container curl; and a pry lug formed in a portion of the closure curl and extending around a portion of the circumference of the metallic closure, the pry lug comprising:

a projection extending outwardly a distance from the substantially vertical portion of the metallic closure;

an inward curve extending from an outer end of the projection; and an inwardly oriented portion extending from an inner end of the inward curve.

2. The food or beverage packaging of claim 1, wherein the pry lug further comprises:

an outward bend extending from the lower end of the substantially vertical portion, wherein the outward bend extends approximately 90 degrees; and the projection extending outwardly from an outer end of the outward bend.

3. The food or beverage packaging of claim 2, wherein the pry lug further comprises a cut end interconnected to the inwardly oriented portion, the cut end being positioned between the central panel and the inwardly oriented portion in a vertical dimension.

4. The food or beverage packaging of claim 1, wherein the metallic closure further comprises a liner attached to the bottom surface of the substantially flat central panel.

5. The food or beverage packaging of claim 4, wherein the liner is a foil liner.

6. The food or beverage packaging of claim 1, wherein the container further comprises a domed portion in the closed bottom end.

7. The food or beverage packaging of claim 6, wherein the container further comprises a well extending downwardly from the lower end of the sidewall, the well having an interior wall interconnected on an upper end to a perimeter of the domed portion.

8. A metallic closure for a container, the metallic closure comprising:

a substantially flat central panel with an upper surface and a bottom surface;

a substantially vertical portion extending downwardly from a perimeter of the central panel;

a closure curl extending inwardly from a lower end of the substantially vertical portion;

a pry lug formed in a portion of the closure curl and extending around a portion of a circumference of the metallic closure, the pry lug comprising:

a projection that extends outwardly a distance from the substantially vertical portion of the metallic container closure;

a curved portion that extends from an outer end of the projection;

an inwardly oriented portion that extends from an inner end of the curved portion; and a cut end that faces the inwardly oriented portion such that the cut end is hidden within the pry lug;

a securing lug formed in a portion of the closure curl and extending around a portion of the circumference of the metallic closure, wherein the securing lug extends inwardly from the substantially vertical portion of the metallic closure and forms a securing loop, and wherein the securing loop of the securing lug engages a peripheral curl of a container; and a liner attached to the bottom surface of the substantially flat central panel.

9. The metallic closure of claim 8, wherein the cut end is positioned between the inwardly oriented portion and the upper surface of the substantially flat central panel.

10. The food or beverage packaging of claim 3, wherein the pry lug further comprises an upward bend positioned between the inwardly oriented portion and the cut end.

11. The food or beverage packaging of claim 10, wherein the cut end is positioned between the upward bend and the inward curve.

12. The food or beverage packaging of claim 3, wherein the cut end faces downwardly toward the inwardly oriented portion.

13. The food or beverage packaging of claim 1, wherein between the securing lug and the pry lug the closure curl has a radius of curvature of between about 0.015 inches and 0.055 inches.

14. The food or beverage packaging of claim 1, wherein the securing lug comprises:

an inward bend extending from the lower end of the substantially vertical portion;

a lower linear portion extending inwardly from an inward end of the inward bend;

an upward bend extending from an inward end of the lower linear portion; and an upper linear portion extending from an upper end of the upward bend.

15. The metallic closure of claim 8, wherein the pry lug further comprises an upward bend positioned between the inwardly oriented portion and the cut end.

16. The metallic closure of claim 15, wherein the cut end is positioned between the upward bend and the curved portion.

17. The metallic closure of claim 8, wherein the liner is a foil liner.

* * * * *